US007920155B2

(12) United States Patent
Miyake

(10) Patent No.: US 7,920,155 B2
(45) Date of Patent: Apr. 5, 2011

(54) IMAGE FORMING APPARATUS AND METHOD OF CONTROLLING THE SAME

(75) Inventor: Kazunori Miyake, Abiko (JP)

(73) Assignee: Canon Kabushiki Kaisha (JP)

( * ) Notice: Subject to any disclaimer, the term of this patent is extended or adjusted under 35 U.S.C. 154(b) by 62 days.

(21) Appl. No.: 12/276,312

(22) Filed: Nov. 22, 2008

(65) Prior Publication Data

US 2009/0135241 A1 May 28, 2009

(30) Foreign Application Priority Data

Nov. 22, 2007 (JP) ..... 2007-302981

(51) Int. Cl.
*B41J 2/435* (2006.01)
*B41J 2/47* (2006.01)

(52) U.S. Cl. ..... 347/234; 347/248

(58) Field of Classification Search ..... 347/229, 347/231, 234, 235, 237, 243, 248–250, 259–261
See application file for complete search history.

(56) References Cited

U.S. PATENT DOCUMENTS 6,650,352 B2 * 11/2003 Pawley et al. ..... 347/234
2002/0130944 A1 * 9/2002 Ema et al. ..... 347/132
2008/0143814 A1 6/2008 Masui et al.

FOREIGN PATENT DOCUMENTS

JP 2003-11424 A 1/2003
JP 2005-172997 A 6/2005
JP 2006-305780 A 11/2006

* cited by examiner

*Primary Examiner* — Hai C Pham
(74) *Attorney, Agent, or Firm* — Rossi, Kimms & McDowell LLP

(57) ABSTRACT

An image forming apparatus that is operable at a plurality of image forming speeds and can be constructed at low costs without adding circuits or the like. A conversion circuit converts image data into lighting patterns for turning on/off laser light on a basis of each of units of auxiliary pixels formed by dividing a pixel as an image forming element. A shift register sequentially stores lighting patterns for pixels pixel from the conversion circuit, and sequentially outputs them to a laser drive circuit. In monochrome printing, the rotational speed of a polygon motor is set to perform a printing operation. In color printing, the difference between an image forming speed for the monochrome printing and an image forming speed for the color printing is calculated, and based on the difference, the amount of insertion of pixel pieces using the shift register is determined for a printing operation.

4 Claims, 22 Drawing Sheets

*FIG. 4A* INPUT AND OUTPUT TIMINGS OF TIMING GENERATING CIRCUIT, LASER DRIVE CIRCUIT, CLOCK GENERATING CIRCUIT
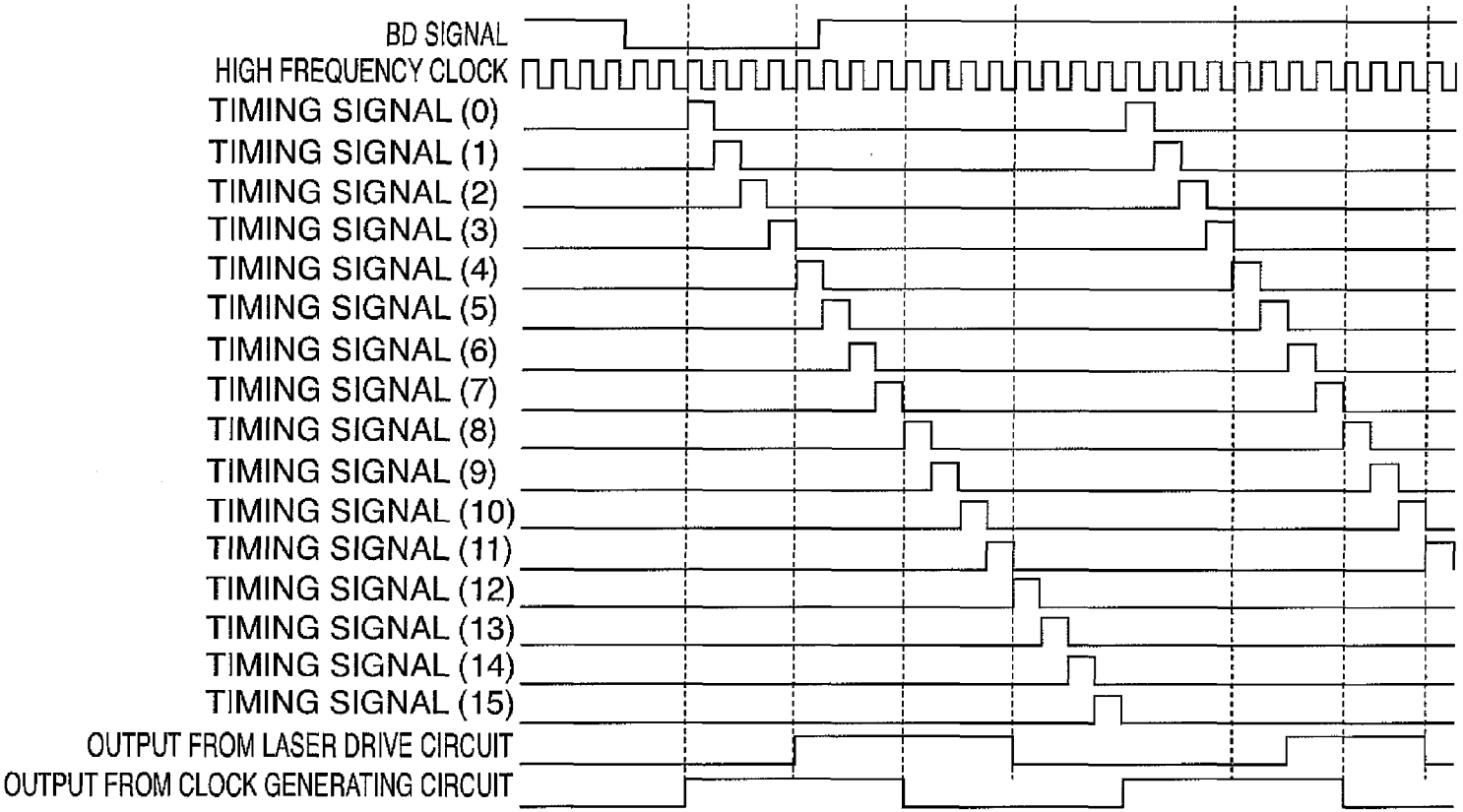
*FIG. 4B* INPUT AND OUTPUT TIMING OF CONVERSION CIRCUIT
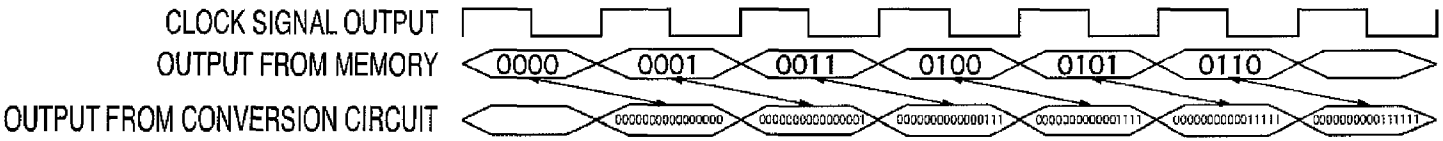

OUTLINE OF OPERATIONS OF CONVERSION CIRCUIT AND SHIFT REGISTER

FIG. 5B

EXAMPLE OF CONVERSION OF DENSITY TO PWM LIGHTING PATTERN BY CONVERSION CIRCUIT

| DENSITY SIGNAL | LIGHTING PATTERN | D01 | D02 | D03 | D04 | D05 | D06 | D07 | D08 | D09 | D10 | D11 | D12 | D13 | D14 | D15 | D16 |
|---|---|---|---|---|---|---|---|---|---|---|---|---|---|---|---|---|---|
| 0×0 | 0×0001 | | | | | | | | | | | | | | | | ■ |
| 0×1 | 0×0003 | | | | | | | | | | | | | | | ■ | ■ |
| 0×2 | 0×0007 | | | | | | | | | | | | | | ■ | ■ | ■ |
| 0×3 | 0×000F | | | | | | | | | | | | | ■ | ■ | ■ | ■ |
| 0×4 | 0×001F | | | | | | | | | | | | ■ | ■ | ■ | ■ | ■ |
| 0×5 | 0×003F | | | | | | | | | | | ■ | ■ | ■ | ■ | ■ | ■ |
| 0×6 | 0×007F | | | | | | | | | | ■ | ■ | ■ | ■ | ■ | ■ | ■ |
| 0×7 | 0×00FF | | | | | | | | | ■ | ■ | ■ | ■ | ■ | ■ | ■ | ■ |
| 0×8 | 0×01FF | | | | | | | | ■ | ■ | ■ | ■ | ■ | ■ | ■ | ■ | ■ |
| 0×9 | 0×03FF | | | | | | | ■ | ■ | ■ | ■ | ■ | ■ | ■ | ■ | ■ | ■ |
| 0×A | 0×07FF | | | | | | ■ | ■ | ■ | ■ | ■ | ■ | ■ | ■ | ■ | ■ | ■ |
| 0×B | 0×0FFF | | | | | ■ | ■ | ■ | ■ | ■ | ■ | ■ | ■ | ■ | ■ | ■ | ■ |
| 0×C | 0×1FFF | | | | ■ | ■ | ■ | ■ | ■ | ■ | ■ | ■ | ■ | ■ | ■ | ■ | ■ |
| 0×D | 0×3FFF | | | ■ | ■ | ■ | ■ | ■ | ■ | ■ | ■ | ■ | ■ | ■ | ■ | ■ | ■ |
| 0×E | 0×7FFF | | ■ | ■ | ■ | ■ | ■ | ■ | ■ | ■ | ■ | ■ | ■ | ■ | ■ | ■ | ■ |
| 0×F | 0×FFFF | ■ | ■ | ■ | ■ | ■ | ■ | ■ | ■ | ■ | ■ | ■ | ■ | ■ | ■ | ■ | ■ |

145
D1(3) 1
D1(2) 2
D1(1) 3
D1(0) 4
D2(3) 5
D2(2) 6
D2(1) 7
D2(0) 8
9
10
11
12
OUTPUT TO LASER DRIVE CIRCUIT 141
INPUT FROM CONVERSION CIRCUIT 144
NUMBER OF INSERTED PIXEL PIECES = 0
PIXEL PIECE INSERTION = NOT EXECUTED

145
D2(3) 1
D2(2) 2
D2(1) 3
D2(0) 4
D2(0) 5
D3(3) 6
D3(2) 7
D3(1) 8
D3(0) 9
10
11
12
OUTPUT TO LASER DRIVE CIRCUIT 141
INPUT FROM CONVERSION CIRCUIT 144
NUMBER OF INSERTED PIXEL PIECES = 0
PIXEL PIECE INSERTION = EXECUTED

145
D2(0) 1
D3(3) 2
D3(2) 3
D3(1) 4
D3(0) 5
D4(3) 6
D4(2) 7
D4(1) 8
D4(0) 9
10
11
12
OUTPUT TO LASER DRIVE CIRCUIT 141
INPUT FROM CONVERSION CIRCUIT 144
NUMBER OF INSERTED PIXEL PIECES = 1
PIXEL PIECE INSERTION = NOT EXECUTED

145
D3(0) 1
D4(3) 2
D4(2) 3
D4(1) 4
D4(0) 5
D4(0) 6
D5(3) 7
D5(2) 8
D5(1) 9
D5(0) 10
11
12
OUTPUT TO LASER DRIVE CIRCUIT 141
INPUT FROM CONVERSION CIRCUIT 144
NUMBER OF INSERTED PIXEL PIECES = 1
PIXEL PIECE INSERTION = EXECUTED

145
D4(0) 1
D4(0) 2
D5(3) 3
D5(2) 4
D5(1) 5
D5(0) 6
D6(3) 7
D6(2) 8
D6(1) 9
D6(0) 10
11
12
OUTPUT TO LASER DRIVE CIRCUIT 141
INPUT FROM CONVERSION CIRCUIT 144
NUMBER OF INSERTED PIXEL PIECES = 2
PIXEL PIECE INSERTION = NOT EXECUTED

145
D5(1) 1
D5(0) 2
D6(3) 3
D6(2) 4
D6(1) 5
D6(0) 6
D6(0) 7
D7(3) 8
D7(2) 9
D7(1) 10
D7(0) 11
12
OUTPUT TO LASER DRIVE CIRCUIT 141
INPUT FROM CONVERSION CIRCUIT 144
NUMBER OF INSERTED PIXEL PIECES = 2
PIXEL PIECE INSERTION = EXECUTED

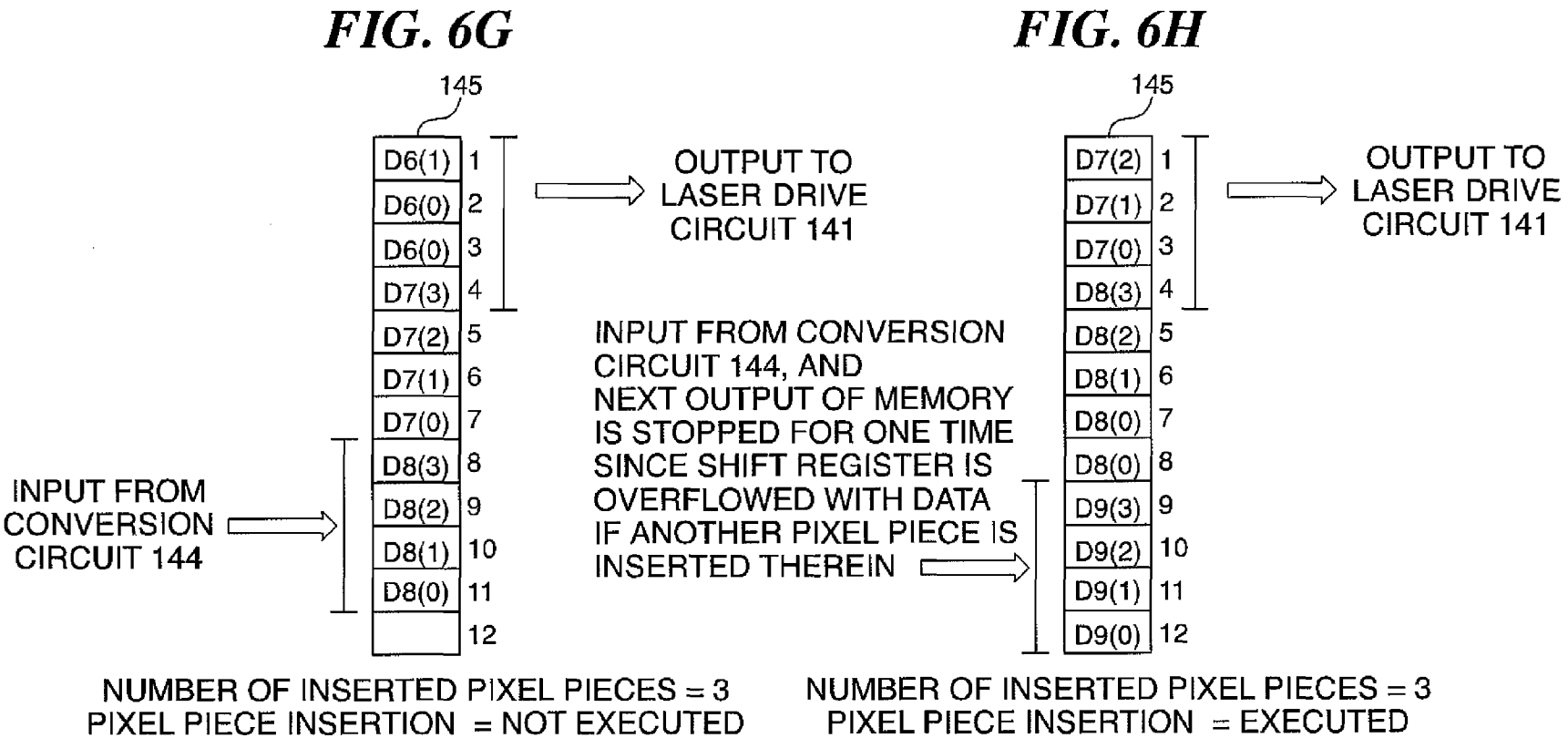
FIG. 6G
145
D6(1) 1
D6(0) 2
D6(0) 3
D7(3) 4
D7(2) 5
D7(1) 6
D7(0) 7
D8(3) 8
D8(2) 9
D8(1) 10
D8(0) 11
12
OUTPUT TO LASER DRIVE CIRCUIT 141
INPUT FROM CONVERSION CIRCUIT 144
NUMBER OF INSERTED PIXEL PIECES = 3
PIXEL PIECE INSERTION = NOT EXECUTED
FIG. 6H
145
D7(2) 1
D7(1) 2
D7(0) 3
D8(3) 4
D8(2) 5
D8(1) 6
D8(0) 7
D8(0) 8
D9(3) 9
D9(2) 10
D9(1) 11
D9(0) 12
OUTPUT TO LASER DRIVE CIRCUIT 141
INPUT FROM CONVERSION CIRCUIT 144, AND NEXT OUTPUT OF MEMORY IS STOPPED FOR ONE TIME SINCE SHIFT REGISTER IS OVERFLOWED WITH DATA IF ANOTHER PIXEL PIECE IS INSERTED THEREIN
NUMBER OF INSERTED PIXEL PIECES = 3
PIXEL PIECE INSERTION = EXECUTED

MONOCHROME PRINTING

COLOR PRINTING

MONOCHROME PRINTING

COLOR PRINTING

MONOCHROME PRINTING

COLOR PRINTING

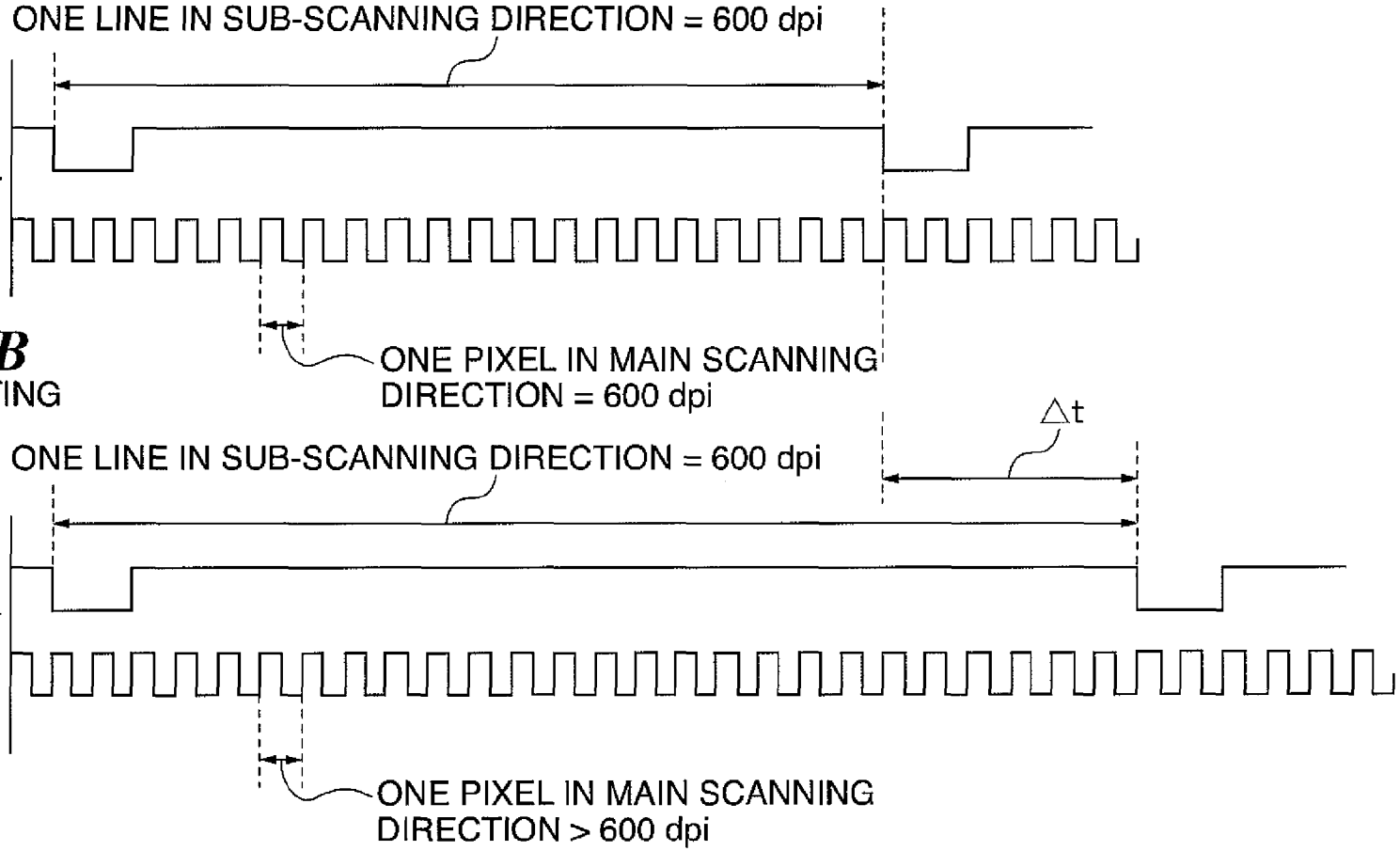
*FIG. 16A* MONOCHROME PRINTING
*FIG. 16B* COLOR PRINTING

MONOCHROME PRINTING

COLOR PRINTING

MONOCHROME PRINTING

COLOR PRINTING

IMAGE FORMING APPARATUS AND METHOD OF CONTROLLING THE SAME

BACKGROUND OF THE INVENTION

1. Field of the Invention

The present invention relates to an electrophotographic image forming apparatus which performs image formation by developing a latent image formed on a photosensitive member using a laser beam, and then transferring the developed image onto a recording sheet, and a method of controlling the image forming apparatus.

2. Description of the Related Art

Conventionally, there has been proposed an image forming apparatus including an image forming section shown in FIGS. 13 and 14, which performs image formation by irradiating a photosensitive member with a laser beam to form a visible image, and then transferring the image onto a recording sheet. A rotary polygon mirror 201 includes four reflecting surfaces (each of which is provided for scanning one line), and is driven for rotation by a polygon motor (laser scanner motor) 202 in a direction indicated by an arrow in FIG. 13. A laser diode 203 is turned on or off by a drive circuit (not shown) according to the image signal, and emits an optically modulated laser beam to the rotary polygon mirror 201.

As the polygon mirror 201 rotates, the laser beam is reflected on the reflecting surfaces of the polygon mirror 201 as a deflection beam continuously changing its angle. Then, the laser beam has its distortion aberration corrected by a lens group (not shown), and is reflected on a reflecting mirror 204, for scanning line by line in the main scanning direction of a photosensitive member 205. The photosensitive member 205 is driven for rotation in a direction indicated by an arrow in FIG. 14, and is charged in advance by a electrostatic charger 206. The photosensitive member 205 is sequentially exposed to light by scanning of the laser beam, whereby an electrostatic latent image is formed thereon. A development device 207 develops the electrostatic latent image with toner to form a visible image. A transfer charger 208 transfers the visible image on the photosensitive member onto a recording sheet conveyed in a direction indicated by an arrow 210 in FIG. 14. The recording sheet having the visible image transferred thereon is conveyed to a fixing device 211 to be fixed, and then is discharged from the apparatus.

In this case, a BD sensor 209 is disposed in the vicinity of a scanning start position at a location toward a lateral side of the photosensitive member 205. The BD sensor 209 detects each laser beam reflected on each reflecting surface of the rotary polygon mirror before scanning of each line by the laser beam, and outputs a BD signal. The BD signal detected is used as a scanning start reference signal indicative of the start of scanning in the main scanning direction. The write start position of each line in the main scanning direction is synchronized with reference to the scanning start reference signal.

Further, there also has been proposed an image forming apparatus provided with an image forming section shown in FIGS. 15A and 15B, which forms color images by mixing toners of four colors (yellow: Y, magenta: M, cyan: C, and black: K). In FIGS. 15A and 15B, members which have functions identical to those of the members appearing in FIGS. 13 and 14 are designated by identical reference numerals (Y, M, C, and K added after the respective reference numerals represent yellow, magenta, cyan, and black image forming members, respectively). Photosensitive members 205Y to 205K are driven for rotation in directions indicated by respective associated arrows in FIG. 15B, and photosensitive surfaces of the respective photosensitive members, charged by electrostatic chargers 206Y to 206K are irradiated with the laser beams to have electrostatic latent images formed thereon.

Development devices 207Y to 207K develop the electrostatic latent images formed on the photosensitive members with toner, for visualization of the latent images. Transfer chargers 208Y to 208K transfer the visualized images on the respective photosensitive members onto a recording sheet conveyed in a direction indicated by an arrow 210 in FIG. 15B. In this case, yellow, magenta, cyan, and black images are sequentially transferred onto the recording sheet by the transfer chargers 208Y to 208K in the mentioned order, to thereby form a color image. The fixing device 211 fixes the color image on the recording sheet.

There have been proposed various techniques concerning an image forming technique that performs image formation in the above-described processes (see e.g. Japanese Patent Laid-Open Publication No. 2005-172997). Further, there has been proposed a technique concerning the rotation control of the rotary polygon mirror, which is applied to a change in an image forming speed (processing speed) (see e.g. Japanese Patent Laid-Open Publication No. 2003-11424). This is a technique capable of changing the rotational speed of the polygon motor (or the rotary polygon mirror) when image formation is performed by changing an image forming speed depending on the type of a recording sheet or the type of an image forming mode (a color mode or a monochrome mode).

However, in the image forming apparatus including the above-described conventional image forming section, when the rotational speed of the polygon motor is switched, an image clock that determines the width of each pixel in the main scanning direction is also required to be switched according to the switched rotational speed. States in which image formation is performed by the image forming apparatus at respective different image forming speeds will be described with reference to FIGS. 16A to 18B.

FIGS. 16A and 16B show the relationship between the BD (Beam Detect) signal and the image clock. In an image forming apparatus forming color images, with a view to improving the productivity, an image forming speed for the monochrome printing and an image forming speed for the color printing are sometimes made different from each other. Further, the image forming speed for the color printing is sometimes inferior to (slower than) the image forming speed for the monochrome printing since the image forming speed for the color printing is limited e.g. by the performance of a fixing device. The examples illustrated in FIGS. 16A and 16B show a case in which the FIG. 16A image forming speed for the monochrome printing is higher than the FIG. 16B image forming speed for the color printing appearing.

In the FIG. 16A monochrome printing, there are set the rotational speed of the polygon motor, i.e. the rotation period thereof (the interval of the BD signal in FIGS. 16A and 16B) for realizing pixels with a resolution of 600 dpi in the main scanning direction and a resolution of 600 dpi in the sub-scanning direction, and an image clock. At this time, when the color printing, whose image forming speed is relatively low, is performed, to realize pixels with the resolution of 600 dpi in the sub-scanning direction, it is required to set the rotational speed of the polygon motor, i.e. the rotation period thereof (the time interval between the BD signal) such that the rotational period is made longer than in the monochrome printing, by a time period $\Delta t$.

However, since the image clock is determined by a clock set for the monochrome printing, it is impossible to change the clock, so that extra pixels corresponding to the time period Δt are set. As a consequence, the resolution of pixels in the main scanning direction becomes higher than 600 dpi, whereby pixels are formed in which a resolution in the main scanning direction and a resolution in the sub-scanning direction are different.

FIGS. 17A and 17B show states of pixels. FIG. 17A shows a state of pixels formed by monochrome printing. As described above with reference to FIG. 16A, the image clock is determined according to the image forming speed during the monochrome printing, and hence it is possible to realize the resolution of 600 dpi in the main scanning direction, and the resolution of 600 dpi in the sub-scanning direction.

FIG. 17B shows a state of pixels formed by color printing. As described above with reference to FIG. 16B, the resolution of 600 dpi in the sub-scanning direction can be realized by setting the rotational speed of the polygon motor to be lower. At this time, since the image clock is set according to the monochrome printing, a larger number of pixels are printed over the same scanning distance, which makes it possible to form pixels with a higher resolution than 600 dpi in the main scanning direction, that is, pixels each having a width narrower than that of 600 dpi.

FIGS. 18A and 18B show the relationship between a recording sheet and an image area. FIG. 18A shows a state of pixels formed by monochrome printing. When the monochrome printing is performed, an image with the resolution of 600 dpi both in the main scanning direction and the sub-scanning direction can be obtained, and hence it is possible to form a predetermined image area on the recording sheet.

FIG. 18B shows a state of pixels formed by color printing. As shown in FIG. 17B, when the color printing is performed, the image area of the recording sheet is made shorter by a length ΔL than when the monochrome printing performed, since an image obtained has a resolution of higher than 600 dpi in the main scanning direction although it has the resolution of 600 dpi in the sub-scanning direction. In other words, this causes the problem that an image reduced in size in the main scanning direction of the recording sheet is formed, resulting in an increased margin.

Therefore, the image clock that determines the width of each pixel in the main scanning direction and has strict jitter requirements is required to be provided such that a different image clock is used according to the image forming speed. This results in necessity of provision of a switching circuit for switching image clocks or the like, which requires the mounting area to be increased and increases in costs. Further, due to the high frequency of the image clock, it is necessary to take strong countermeasures against undesired noise emission and the like.

SUMMARY OF THE INVENTION

This invention provides an image forming apparatus that is operable at a plurality of image forming speeds and can be constructed at low costs without adding circuits or the like, and a method of controlling the image forming apparatus.

In a first aspect of the present invention, there is provided an image forming apparatus including an image forming unit that forms an image on a recording medium based on image data by emitting a laser beam from a laser light source onto a photosensitive member to form a latent image thereon and visualizing the latent image formed on the photosensitive member, comprising a conversion unit configured to convert the image data into lighting patterns for turning on and off the laser light source on a basis of each of auxiliary pixels formed by dividing each pixel as an image forming element, a storage unit configured to sequentially store lighting patterns each for one pixel from the conversion unit, and sequentially output the lighting patterns to the image forming unit, the storage unit being capable of accumulating the lighting patterns for a plurality of pixels, a storage control unit configured to perform control, when a lighting pattern for one pixel is stored from the conversion unit into the storage unit, such that an auxiliary pixel is added to the one pixel, a calculation unit configured to calculate a difference between a first image forming speed at which image formation is performed by the image forming unit, and a second image forming speed at which image formation is performed by the image forming unit and which is lower than the first image forming speed, and a determination unit configured to determine an amount of addition of auxiliary pixels to be performed using the storage unit based on the difference calculated by the calculation unit.

In a second aspect of the present invention, there is provided an image forming apparatus including an image forming unit that forms an image on a recording medium based on image data by emitting a laser beam from a laser light source onto a photosensitive member to form a latent image thereon and visualizing the latent image formed on the photosensitive member, comprising a conversion unit configured to convert the image data into lighting patterns for turning on and off the laser light source on a basis of each of auxiliary pixels formed by dividing each pixel as an image forming element, a storage unit configured to sequentially store lighting patterns each for one pixel from the conversion unit, and sequentially output the lighting patterns to the image forming unit, the storage unit being capable of accumulating the lighting patterns for a plurality of pixels, a storage control unit configured to perform control, when a lighting pattern for one pixel is stored from the conversion unit into the storage unit, such that an auxiliary pixel is deleted from the one pixel, a calculation unit configured to calculate a difference between a first image forming speed at which image formation is performed by the image forming unit, and a second image forming speed at which image formation is performed by the image forming unit and which is lower than the first image forming speed, and a determination unit configured to determine an amount of deletion of auxiliary pixels to be performed using the storage unit based on the difference calculated by the calculation unit.

In a third aspect of the present invention, there is provided an image forming apparatus including an image forming unit that forms an image on a recording medium based on image data by emitting a laser beam from a laser light source onto a photosensitive member to form a latent image thereon and visualizing the latent image formed on the photosensitive member, comprising a conversion unit configured to convert the image data into lighting patterns for turning on and off the laser light source on a basis of each of auxiliary pixels formed by dividing each pixel as an image forming element, a storage unit configured to sequentially store lighting patterns each for one pixel from the conversion unit, and sequentially output the lighting patterns to the image forming unit, the storage unit being capable of accumulating the lighting patterns for a plurality of pixels, a storage control unit configured to perform control, when a lighting pattern for one pixel is stored from the conversion unit into the storage unit, such that an auxiliary pixel is added to or deleted from the one pixel, a first calculation unit configured to calculate a difference between a third image forming speed between a first image forming speed at which image formation is performed by the image forming unit, and a second image forming speed at which image formation is performed by the image forming unit and which is lower than the first image forming speed, and the first image forming speed, a second calculation unit configured to calculate a difference between the third image forming speed and the second image forming speed, a first determination unit configured to determine an amount of addition of auxiliary pixels to be performed using the storage unit based on the difference calculated by the first calculation unit; and a second determination unit configured to determine an amount of deletion of auxiliary pixels to be performed using the storage unit based on the difference calculated by the second calculation unit.

In a fourth aspect of the present invention, there is provided a method of controlling an image forming apparatus including an image forming unit that forms an image on a recording medium based on image data by emitting a laser beam from a laser light source onto a photosensitive member to form a latent image thereon and visualizing the latent image formed on the photosensitive member, comprising converting the image data into lighting patterns for turning on and off the laser light source on a basis of each of auxiliary pixels formed by dividing each pixel as an image forming element, performing, when a lighting pattern for one pixel is stored into a storage unit, control such that an auxiliary pixel is added to the one pixel, the storage unit being configured to sequentially store lighting patterns converted from the image data each for one pixel, and sequentially output the lighting patterns to the image forming unit, the storage unit being capable of accumulating the lighting patterns for a plurality of pixel, calculating a difference between a first image forming speed at which image formation is performed by the image forming unit, and a second image forming speed at which image formation is performed by the image forming unit and which is lower than the first image forming speed, and determining an amount of addition of auxiliary pixels to be performed using the storage unit based on the calculated difference.

In a fifth aspect of the present invention, there is provided a method of controlling an image forming apparatus including an image forming unit that forms an image on a recording medium based on image data by emitting a laser beam from a laser light source onto a photosensitive member to form a latent image thereon and visualizing the latent image formed on the photosensitive member, comprising converting the image data into lighting patterns for turning on and off the laser light source on a basis of each of auxiliary pixels formed by dividing each pixel as an image forming element, performing, when a lighting pattern for one pixel is stored into a storage unit, control such that an auxiliary pixel is deleted from the one pixel, the storage unit being configured to sequentially store lighting patterns converted from the image data each for one pixel, and sequentially output the lighting patterns to the image forming unit, the storage unit being capable of accumulating the lighting patterns for a plurality of pixels, calculating a difference between a first image forming speed at which image formation is performed by the image forming unit, and a second image forming speed at which image formation is performed by the image forming unit and which is lower than the first image forming speed, and determining an amount of deletion of auxiliary pixels to be performed using the storage unit based on the calculated difference.

In a sixth aspect of the present invention, there is provided an image forming apparatus including an image forming unit that forms an image on a recording medium based on image data by emitting a laser beam from a laser light source onto a photosensitive member to form a latent image thereon and visualizing the latent image formed on the photosensitive member, comprising converting the image data into lighting patterns for turning on and off the laser light source on a basis of each of auxiliary pixels formed by dividing each pixel as an image forming element, performing, when a lighting pattern for one pixel is stored into a storage unit, control such that an auxiliary pixel is added to or deleted from the one pixel, the storage unit being configured to sequentially store lighting patterns converted from the image data each for one pixel, and sequentially output the lighting patterns to the image forming unit, the storage unit being capable of accumulating the lighting patterns for a plurality of pixels, calculating a difference between a third image forming speed between a first image forming speed at which image formation is performed by the image forming unit, and a second image forming speed at which image formation is performed by the image forming unit and which is lower than the first image forming speed, and the first image forming speed, calculating a difference between the third image forming speed and the second image forming speed, determining an amount of addition of auxiliary pixels to be performed using the storage unit based on the calculated difference between the third image forming speed and the first image forming speed, and determining an amount of deletion of auxiliary pixels to be performed using the storage unit based on the calculated difference between the third image forming speed and the second calculation unit.

According to the present invention, the amount of addition of auxiliary pixels or the amount of deletion of auxiliary pixels using the storage unit is determined based on the difference between the first image forming speed and the second image forming speed lower than the first image forming speed. Alternatively, the amount of addition of auxiliary pixels and the amount of deletion of auxiliary pixels are determined based on the difference between the third image forming speed and the first image forming speed and the difference between the third image forming speed and the second image forming speed, respectively. Therefore, it is possible to construct an image forming apparatus operable at a plurality of image forming speeds at low costs without adding circuits or the like.

The features and advantages of the invention will become more apparent from the following detailed description taken in conjunction with the accompanying drawings.

BRIEF DESCRIPTION OF THE DRAWINGS

FIG. 4A is a diagram showing the input and output timings of a timing generation circuit, a laser drive circuit, and a clock generating circuit.

FIG. 4B is a diagram showing the input and output timings of a conversion circuit.

FIG. 5B is a view showing an example of conversion of densities to PWM lighting patterns by the conversion circuit.

FIGS. 6A to 6H are views showing operations performed on the PWM lighting pattern using the shift register.

FIG. 16A is a view showing the relationship between a BD signal and an image clock during monochrome printing.

FIG. 16B is a view showing the relationship between the SD signal and the image clock during color printing.

DETAILED DESCRIPTION OF THE EMBODIMENTS

The present invention will now be described in detail below with reference to the accompanying drawings showing embodiments thereof.

Figure 1:
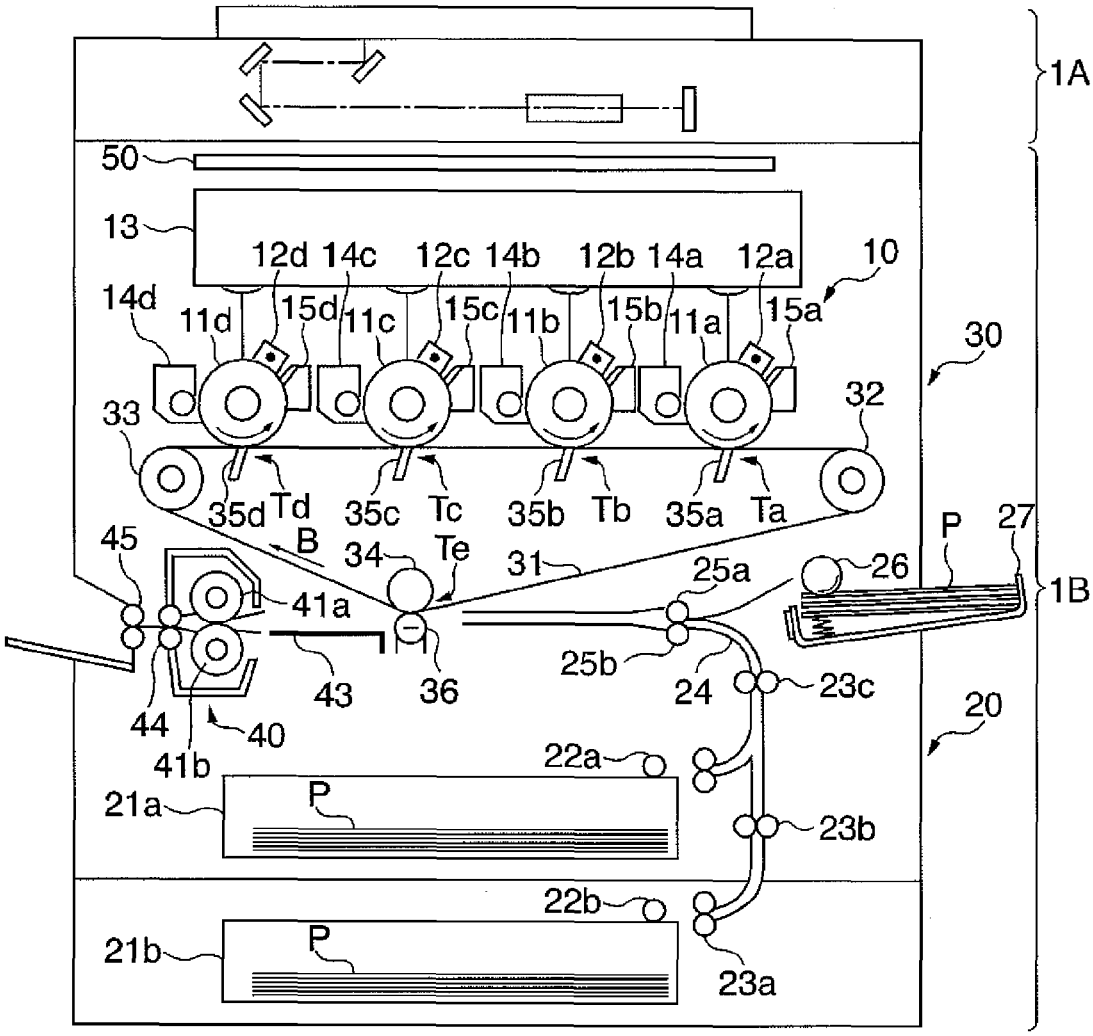
FIG. 1 is a schematic longitudinal cross-sectional view of an image forming apparatus according to a first embodiment of the present invention.

FIG. 1 is a diagram showing the configuration of an image forming apparatus according to a first embodiment of the present invention.

As shown in FIG. 1, the image forming apparatus is configured as a copying machine in which a plurality of image forming stations for forming images by electrophotography are arranged in parallel, and is comprised of an image input section 1A and an image output section 1B. The image input section 1A optically reads an image of an original, and delivers an image signal to the image output section 1B. The image output section 1B is broadly comprised of an image forming section 10, a sheet feed unit 20, an intermediate transfer unit 30, a fixing unit 40, and a control unit 50, and is provided for forming color images on recording sheets.

The image forming section 10 (image forming unit) includes the following four image forming stations, and a laser scanner unit 13. The image forming station 10*a* is comprised of a photosensitive member 11*a*, a primary electrostatic charger 12*a*, and a development device 14*a*. The image forming station 10*b* is comprised of a photosensitive member 11*b*, a primary electrostatic charger 12*b*, and a development device 14*b*. The image forming station 10*c* is comprised of a photosensitive member 11*c*, a primary electrostatic charger 12*c*, and a development device 14*c*. The image forming station 10*d* is comprised of a photosensitive member 11*d*, a primary electrostatic charger 12*d*, and a development device 14*d*.

The photosensitive members 11*a* to 11*d* are image bearing members (photosensitive drums) which are driven for rotation about respective drive shafts in directions indicated by respective arrows, and on which electrostatic latent images are formed. Arranged around the respective photosensitive members 11*a* to 11*d* are the primary electrostatic chargers 12*a* to 12*d*, the development devices 14*a* and 14*d*, and cleaning units 15*a* to 15*d*. In the vicinities of the respective photosensitive members 11*a* to 11*d*, BD sensors (not shown) are arranged each for detecting a laser beam reflected from each reflecting surface of a rotary polygon mirror, referred to hereinafter, before scanning of each line by the laser beam, and outputs a BD signal (scanning start reference signal in the main scanning direction). The primary electrostatic chargers 12*a* to 12*d* each uniformly apply a predetermined amount of electric charge to the surface of the associated one of the photosensitive members 11*a* to 11*d*.

Figure 2:
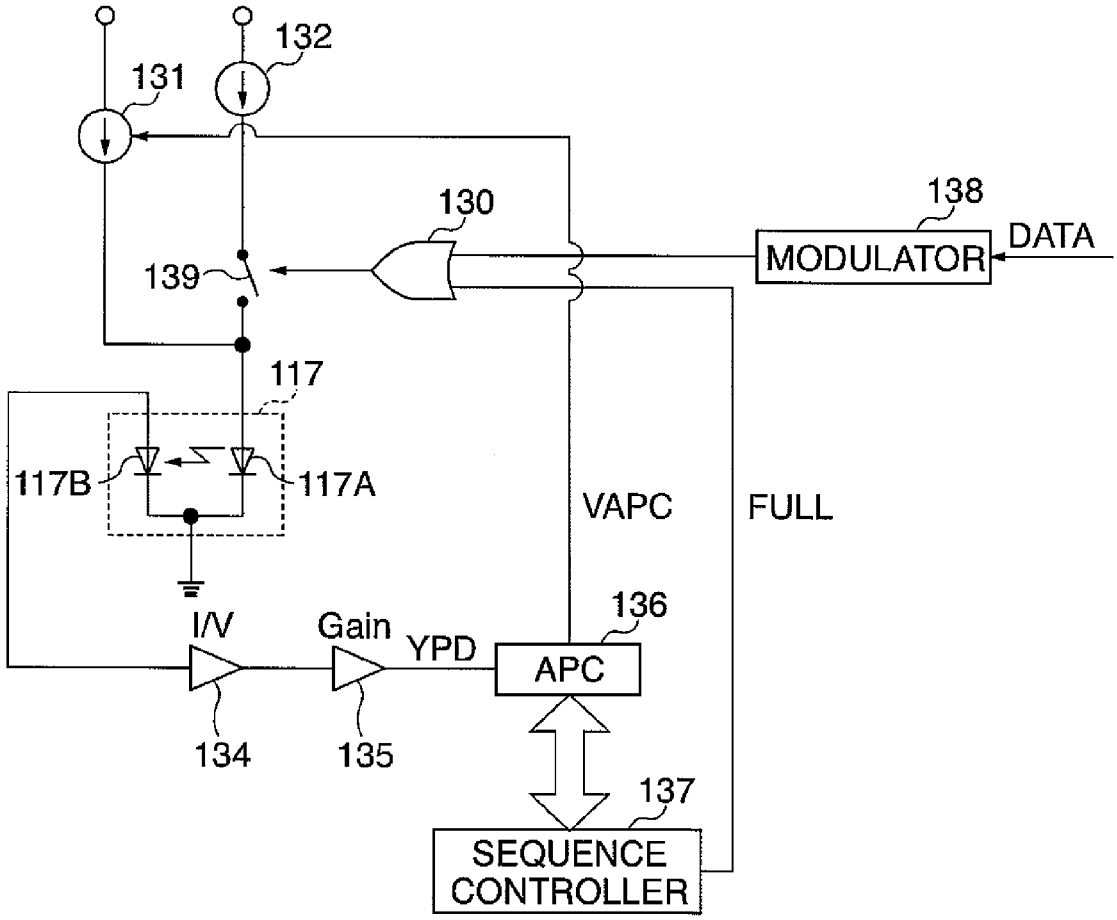
FIG. 2 is a block diagram of a laser control circuit of the image forming apparatus.

The laser scanner unit 13 is comprised of a semiconductor laser (laser light source) that emits a laser beam, the rotary polygon mirror that reflects the laser beam, a polygon motor that drives the rotary polygon mirror for rotation, and a laser control circuit (FIG. 2). The laser scanner unit 13 irradiates the respective photosensitive members 11*a* to 11*d* with the laser beam that is modulated according to an image signal delivered from the image input section 1A, thereby forming respective electrostatic latent images on the photosensitive members 11*a* to 11*d*. The development devices 14*a* and 14*d* store yellow, magenta, cyan, and black developers (hereinafter referred to as "toners"), respectively, and develop the electrostatic latent images on the photosensitive members 11*a* to 11*d* by the toners, for visualization of the same.

The sheet feed unit 20 includes sheet feed cassettes 21*a* and 21*b* that contain recording sheets (recording media) P, a manual feed tray 27, and pickup rollers 22*a*, 22*b*, and 26 that feed the recording sheets P one by one. Further, the sheet feed unit 20 includes feed roller pairs 23*a*, 23*b*, and 23*c* that convey the recording sheets P, a feed guide 24, and a pair of registration rollers 25*a* and 25*b*. The registration rollers 25*a* and 25*b* send out each recording sheet P to a secondary transfer area Te, referred to hereinafter, in timing synchronous with image forming operation of the image forming section 10.

The intermediate transfer unit 30 includes an intermediate transfer belt 31 that is tensely wound (stretched) around a driving roller 32, a tension roller 33, and a secondary transfer opposed roller 34, for being driven for circulation. The driving roller 32 is driven for rotation by a pulse motor, and transmits a driving force to the intermediate transfer belt 31. The tension roller 33 imparts a suitable tensile force to the intermediate transfer belt 31 by the urging force of a spring (not shown). The secondary transfer opposed roller 34 is opposed to a secondary transfer roller 36, referred to hereinafter.

A primary transfer plane A is formed between the driving roller 32 and the tension roller 33 of the intermediate transfer belt 31. The intermediate transfer belt 31 is made e.g. of PET (polyethylene terephthalate), PVdF (polyvinylidene fluoride), or the like. The drive roller 32 is formed by coating the surface of a metal roller with a rubber (urethane rubber or chloroprene rubber) layer having a thickness of several millimeters, so as to prevent a slip between the intermediate transfer belt 31 and the drive roller 32 itself.

Primary transfer areas Ta to Td are formed at respective locations where the photosensitive members 11*a* to 11*d* are opposed to the intermediate transfer belt 31. Further, primary transfer chargers 35*a* to 35*d* are arranged at locations on the reverse (inner) side of the intermediate transfer belt 31 corresponding to the primary transfer areas Ta to Td, respectively. The visualized toner images on the photosensitive members 11*a* to 11*d* are primarily transferred onto the intermediate transfer belt 31 in the primary transfer areas Ta to Td.

The secondary transfer roller 36 is disposed in a manner opposed to the secondary transfer opposed roller 34 with the intermediate transfer belt 31 therebetween. A pressure contact portion (nip) between the secondary transfer roller 36 and the intermediate transfer belt 31 is formed as the secondary transfer area Te. The secondary transfer roller 36 is pressed against the intermediate transfer belt 31 under appropriate pressure. The toner images transferred onto the intermediate transfer belt 31 are transferred onto a recording sheet fed from the sheet feed unit 20, by the secondary transfer roller 36 in the secondary transfer area Te. The recording sheet onto which the toner images have been transferred is conveyed to the fixing unit 40 by the transfer guide 26.

The fixing unit 40 includes a fixing rollers 41*a* and 41*b*, a guide 43, an inner discharge roller 44, and an outer discharge roller 45. The fixing roller 41*a* contains a heat source, such as a halogen heater. The fixing roller 41*b* is pressed against the fixing roller 41*a*, and sometimes contains a heat source. The guide 43 guides the recording sheet into a nip between the fixing rollers 41*a* and 41*b*. The inner discharge roller 44 and the outer discharge roller 45 discharge the recording sheet having been subjected to fixing, from the image forming apparatus.

The control unit 50 is comprised of a control circuit board (not shown) for controlling the operations of the devices in the image output section 1B, a motor drive circuit board (not shown), and so forth. A controller (CPU) 50-1 (a storage control unit, a calculation unit, a first calculation unit, a second calculation unit, a determination unit, a first determination unit, and a second determination unit) provided in the control circuit board of the control unit 50 controls sections and components of the image forming apparatus, including the laser control circuit, described hereinafter. Further, the controller 50-1 of the control unit 50 executes processes, of which descriptions will be given with reference to illustrated flowcharts, based on programs.

Next, a description will be given of the operation of the image output section 1B.

When an image forming operation start signal is delivered from the controller 50-1 of the control unit 50, an operation is started for feeding a sheet from one of the sheet feed cassettes 21*a* and 21*b* and the manual feed tray 27, selected in association with a sheet size designated by the user. Assuming, for example, that recording sheets are fed from the sheet feed cassette 21*a*, first, the recording sheets P are sequentially fed one by one from the sheet feed cassette 21*a* by the pickup roller 22*a*. Next, each recording sheet P is guided via the feed guide 24 by the feed roller pair 23*c*, and is conveyed to the registration rollers 25*a* and 25*b*.

At this time, the registration rollers 25*a* and 25*b* are held in stoppage, and hence the leading end of the recording sheet P abuts against a nip between the registration rollers. Thereafter, the registration rollers 25*a* and 25*b* start rotation in timing synchronous with the start of image formation by the image forming section 10. Timing for the start of rotation of the registration rollers 25*a* and 25*b* is set such that a toner image primarily transferred onto the intermediate transfer belt 31 by the image forming section 10 and the recording sheet P just meet each other in the secondary transfer area Te.

On the other hand, in the image forming section 10, when the image forming operation start signal described above is delivered, the primary transfer is performed as follows. A toner image formed on the photosensitive drum 11*d* at the most upstream location, as viewed in the direction of rotation of the intermediate transfer belt 31, is primarily transferred onto the intermediate transfer belt 31 in the primary transfer area Td by the primary-transfer charger 35*d* to which a high voltage is applied. The toner image primarily transferred onto the intermediate transfer belt 31 is conveyed (moved) to the next primary transfer area Tc as the intermediate transfer belt 31 is driven for circulation.

In the image forming station 10*c* associated with the primary transfer area Tc, image formation is performed in timing delayed by a time period required for conveyance of the toner image from the primary transfer area Td to the primary transfer area Tc, whereby in the primary transfer area Tc, a toner image is transferred onto the image from the immediately upstream primary transfer area Td, in aligned registration with the image from the upstream primary transfer area Td. A similar operation is repeatedly carried out in each of the primary transfer areas Tb and Ta, and after all, the toner images in the respective four colors are primarily transferred onto the intermediate transfer belt 31.

On the other hand, when the fed recording sheet P enters the secondary transfer area Te, and is brought into contact with the intermediate transfer belt 31, high voltage is applied to the secondary transfer roller 36 in timing synchronous with passage of the recording sheet P. In accordance with the application of the high voltage, the toner images in the four colors on the intermediate transfer belt 31 are transferred onto the surface of the recording sheet P. The recording sheet P onto which the toner images have been transferred is guided by the guide 43 to the nip between the fixing rollers 41*a* and 41*b*, and the toner images are fixed to the recording sheet P by the heat of the fixing rollers 41*a* and 41*b* and the pressure of the nip. Then, the recording sheet P is discharged out of the apparatus conveyed by the inner and outer discharge rollers 44 and 45.

FIG. 2 is a block diagram of the laser control circuit of the image forming apparatus.

Referring to FIG. 2, the laser control circuit is installed in the laser scanner unit 13. The laser control circuit includes a laser chip 117, a logic element 130, a bias current source 131, a pulse current source 132, a current voltage converter 134, an amplifier 135, an APC circuit 136, a sequence controller 137, a modulator 138, and a switch 139. The laser control circuit performs the following control: The laser control circuit obtains pixel pieces (auxiliary pixels) by dividing each pixel generated based on density data (image data) by an integer set in advance, and scans a laser beam generated by driving the semiconductor laser on an auxiliary pixel-by-auxiliary pixel basis, via the rotary polygon mirror, to thereby form an electrostatic latent image on the associated photosensitive member.

The laser chip 117 is formed by a pair of a semiconductor laser 117A and a PD (Photo Diode) sensor 117B. Two current sources, i.e. the bias current source 131 and the pulse current source 132 are applied to the laser 117A, whereby the light emitting characteristics of the semiconductor laser 117A are improved. Further, to stabilize the light emission of the laser 117A, the bias current source 131 is fed back using an output signal from the PD sensor 117B to automatically control the amount of bias current.

More specifically, the logic element 130 outputs an ON signal to the switch 139 based on a full lighting signal output from the sequence controller 137, whereby the sum of electric currents output from the bias current source 131 and the pulse current source 132 flows through the laser 117A. At this time, an output signal from the PD sensor 117B is input to the current voltage converter 134, and is then amplified by the amplifier 135. After that, the output signal from the PD sensor 117B is input to the APC circuit 136, and is supplied as a control signal from the APC circuit 136 to the bias current source 131. The control system comprised of the above-mentioned circuits is referred to as the "APC (Auto Power Control) circuit system, and is currently generally used for driving the laser.

The laser has temperature characteristics. As the temperature of the laser becomes higher, the amount of an electric current for obtaining a predetermined amount of light increases. Further, the laser generates heat by itself, which makes it impossible to obtain the predetermined amount of light simply by supplying a predetermined electric current to the laser. These characteristics of the laser have serious influence on image formation.

In the present embodiment, as a solution to these problems, the predetermined amount of electric current that should be caused to flow for each scan is controlled by the APC circuit system whenever each photosensitive member is scanned by the laser beam, such that the light emitting characteristics of the laser are constant for each scan. More specifically, based on data modulated by the modulator 138, the ON/OFF operation of the switch 139 is controlled by the APC circuit 136 via the sequence controller 137, whereby the laser beam, the light amount of which is controlled to be constant, is irradiated onto the photosensitive members 11*a* to 11*d* for forming electrostatic latent images thereon, to thereby form a developed toner image on the recording sheet.

Figure 3:
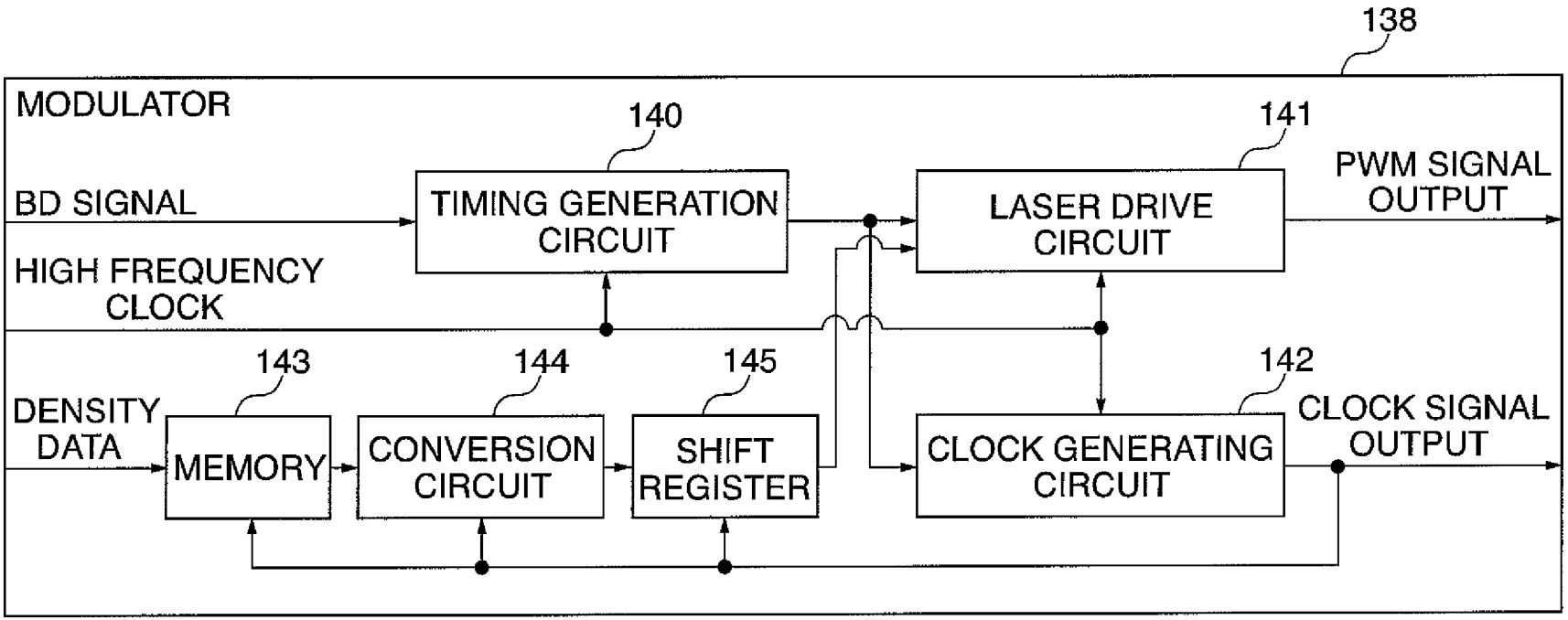
FIG. 3 is a block diagram of a modulator of the image forming apparatus.

FIG. 3 is a block diagram of the modulator 138 of the laser control circuit.

As shown in FIG. 3, the modulator 138 includes a timing generation circuit 140, a laser drive circuit 141 (drive unit), a clock generating circuit 142 (generating unit), a memory 143 (memory unit), a conversion circuit 144 (conversion unit), and a shift register 145 (storage unit). The timing generation circuit 140 operates in timing synchronous with output of the BD signal that is generated by detecting light emitted from the laser 117A using a BD sensor (not shown). The laser drive circuit 141 and the clock generating circuit 142 operate in timing synchronous with output of a timing signal from the timing generation circuit 140.

The laser drive circuit 141 generates and outputs PWM (Pulse Width Modulation) signals for driving the laser based on output from the shift register 145. The clock generating circuit 142 outputs a clock signal (hereinafter simply referred to as "the clock") to the memory 143, the conversion circuit 144, and the shift register 145. The timing generation circuit 140, the laser drive circuit 141, and the clock generating circuit 142 operate with reference to a high frequency clock (FIGS. 4A and 4B).

The memory 143 receives density data from an image processing circuit (not shown), and outputs a density signal for each pixel (image forming element) to the conversion circuit 144 in synchronism with the clock which is output from the clock generating circuit 142 on a pixel-by-pixel basis. In this case, the density data may be density data of an image read from an original by the image input section 1A, or density data of an image to be printed, transmitted from an external device (e.g. a personal computer) connected to the image forming apparatus. As described hereinafter, each pixel is formed by a plurality of auxiliary pixels.

The conversion circuit 144 converts the density signal for each pixel output from the memory 143 into a PWM lighting pattern signal (signal for turning on/off the semiconductor laser) for the pixel, as a basis of a PWM signal output from the laser drive circuit 141, on a pixel piece-by-pixel piece basis (on a basis of each of auxiliary pixels). The PWM lighting pattern signal is for turning on/off the semiconductor laser.

The shift register 145 sequentially stores pulses of the PWM lighting pattern signal for each pixel from the conversion circuit 144, and shifts the PWM lighting pattern signal to sequentially output the same to the laser drive circuit 141. The shift register 145 is capable of storing pulses of the PWM lighting pattern signal for a plurality of pixels. In this case, the control unit 50 performs control such that when pulses of the PWM lighting pattern signal for each pixel are stored from the conversion circuit 144 into the shift register 145, a pixel piece (auxiliary pixel) is inserted (added) into (to) the PWM lighting pattern signal for storage, as required. The details of the manner of insertion of a pixel piece (auxiliary pixel) into the PWM lighting pattern signal (addition of a pixel piece thereto), and removal (deletion) thereof from the PWM lighting pattern signal will be described with reference to FIG. 6 et seq.

Next, the operations of the image forming apparatus configured as above, according to the present embodiment, will be described in detail with reference to FIGS. 4A to 12. The operations include a method of realizing the insertion of a pixel piece.

FIG. 4A is a diagram showing the input and output timings of the timing generation circuit 140, the laser drive circuit 141, and the clock generating circuit 142. FIG. 4B is a diagram showing the input and output timings of the conversion circuit 144.

Referring to FIG. 4A, the high frequency clock is changed with the resolution of one pixel. In the present embodiment, the high frequency clock is configured to divide a pixel into 16 sections, and hence it has a frequency equal to 1/16 of the frequency corresponding to each pixel. The timing generation circuit 140 detects the fall of the BD signal, and timing signals (0 to 15) start operations in predetermined timing.

First, the timing signal (0) becomes high during a section H of the high frequency clock, and in synchronism with the high frequency clock, the timing signal (1), the timing signal (2) . . . sequentially become high. When the timing signal (15) becomes high, then, the timing signal (0) becomes high. The timing generation circuit 140 outputs the timing signals (0 to 15) in timing synchronous with input of the BD signal, and repeatedly outputs the same timing signals (0 to 15) until the next BD signal is input.

The laser drive circuit 141 outputs the PWM signal according to the timing signals (0 to 15) delivered from the timing generation circuit 140, and the PWM lighting pattern signal delivered from the shift register 145. In the illustrated example, the laser drive circuit 141 receives the PWM lighting pattern signal for each pixel, which is high during a section between the timing signal (4) and the timing signal (11), and outputs the PWM signal for the pixel, which is high between the section.

The clock generating circuit 142 outputs a clock (hereinafter referred to as an "image clock") for each pixel according to the timing signals (0 to 15). In the illustrated example, the clock generating circuit 142 generates and outputs an image clock which rises with the timing signal (0), and falls with the timing signal (8).

Referring to FIG. 4B, the conversion circuit 144 converts the density signal, which is a 4-bit signal, output from the memory 143 into the 16-bit PWM lighting pattern signal, and outputs the PWM lighting pattern signal to the shift register 145.

Figure 5A:
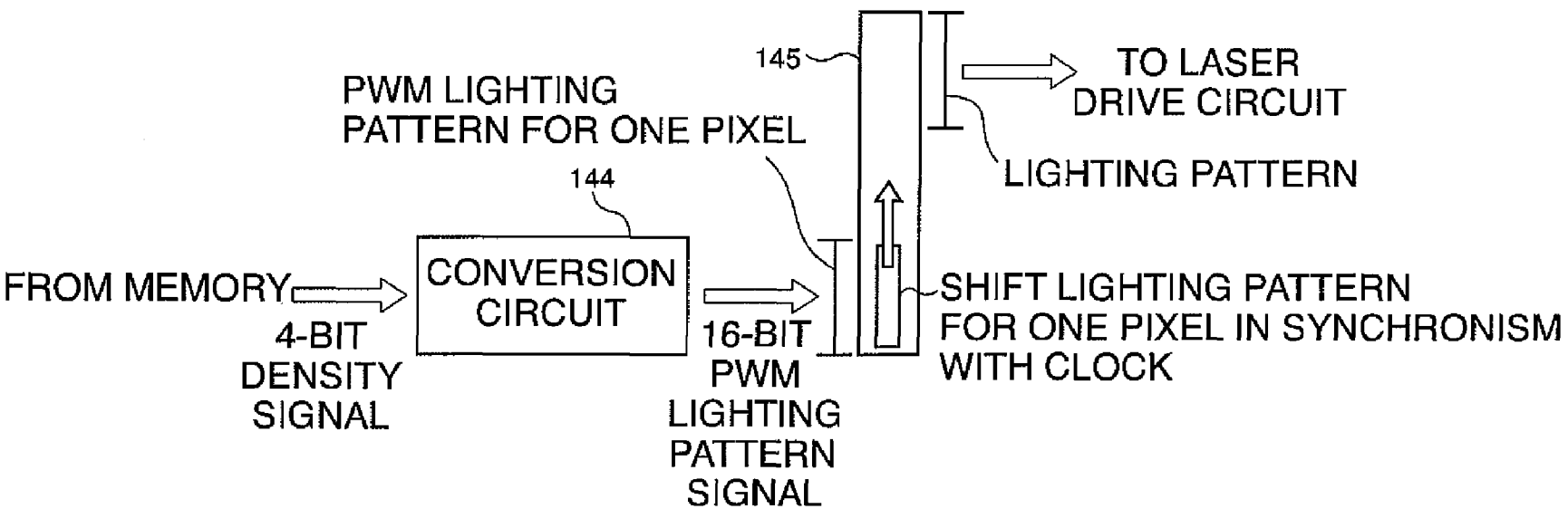
FIG. 5A is a schematic diagram useful in explaining the operations of the conversion circuit and a shift register.

FIG. 5A is a schematic diagram useful in explaining the operations of the conversion circuit 144 and a shift register 145, and FIG. 5B is a view showing an example of conversion of density—PWM lighting pattern by the conversion circuit 144.

Referring to FIG. 5A, the conversion circuit 144 converts the 4-bit density signal output from the memory 143 into the 16-bit PWM lighting pattern signal, and inputs the PWM lighting pattern signal to the shift register 145. The shift register 145 has a sufficiently large capacity for storing lighting patterns for at least two pixels (e.g. three pixels in the present embodiment) for use in turning on the laser. The shift register 145 shifts the lighting pattern for one pixel (=16 bits) in synchronism with the clock output from the clock generating circuit 142. The shift register 145 outputs 16 bits of oldest data items as the PWM lighting pattern signal, to the laser drive circuit 141.

In FIG. 5B, the leftmost column indicates modes of the 4-bit density signal output from the memory 143, in which each mode of the 4-bit density signal is represented by a hexadecimal digit. The next column shows examples of the PWM lighting pattern represented by a hexadecimal digit. The still next 16 columns show examples of the PWM lighting pattern each represented in a manner associated with the binary number system, for purposes of ease of understanding. In the illustrated case, the PWM lighting pattern is converted by an "end growing method" such that it is sequentially increased in size in association with density data from one end of the pattern. The method of the conversion in FIG. 5B is only an example, and it may be a "center growing method" in which the pattern is grows from a center thereof, or a "log conversion method". Further, the conversion table illustrated in FIG. 5B may be stored in the memory of the image forming apparatus.

FIGS. 6A to 6H are views showing operations performed on the PWM lighting pattern in the shift register 145.

As shown in FIGS. 6A to 6H, the operations performed on the PWM lighting pattern in the shift register 145 can provide the following advantageous effects: It is possible to correct the scanning speed of the laser on the photosensitive members 11*a* to 11*d*, adjust the magnifications (scanning lengths) of the plurality of image forming stations, match the magnifications (scanning lengths) of the plurality of lasers with each other, and so forth. In short, it is possible to correct improper scanning positions on the photosensitive members 11*a* to 11*d*.

In the present embodiment, a description will be given of the method of inserting (adding) a pixel piece (auxiliary pixel) into (to) the PWM lighting pattern signal and storing the resulting signal in the shift resister 145, as a method of operating the PWM lighting pattern. The pixel pieces are generated by the conversion circuit 144 based on information which is specific to each image forming apparatus, and is stored in advance in a nonvolatile memory, not shown, of the apparatus. The pixel pieces are supplied to the shift register 145. The location where the pixel pieces are generated is not limited to the conversion circuit 144, but they may be generated at any other suitable location, as required.

It should be noted that for convenience of description, each pixel is assumed to be formed by four auxiliary pixels. Reference numerals in squares in FIGS. 6A to 6H designate data. Data D1(3) represents the most significant bit of a first pixel, and Data D3(0) represents the least significant bit of a third pixel. Further, numerals beside the respective squares indicate addresses within the shift register.

Figures 6A, 6B:
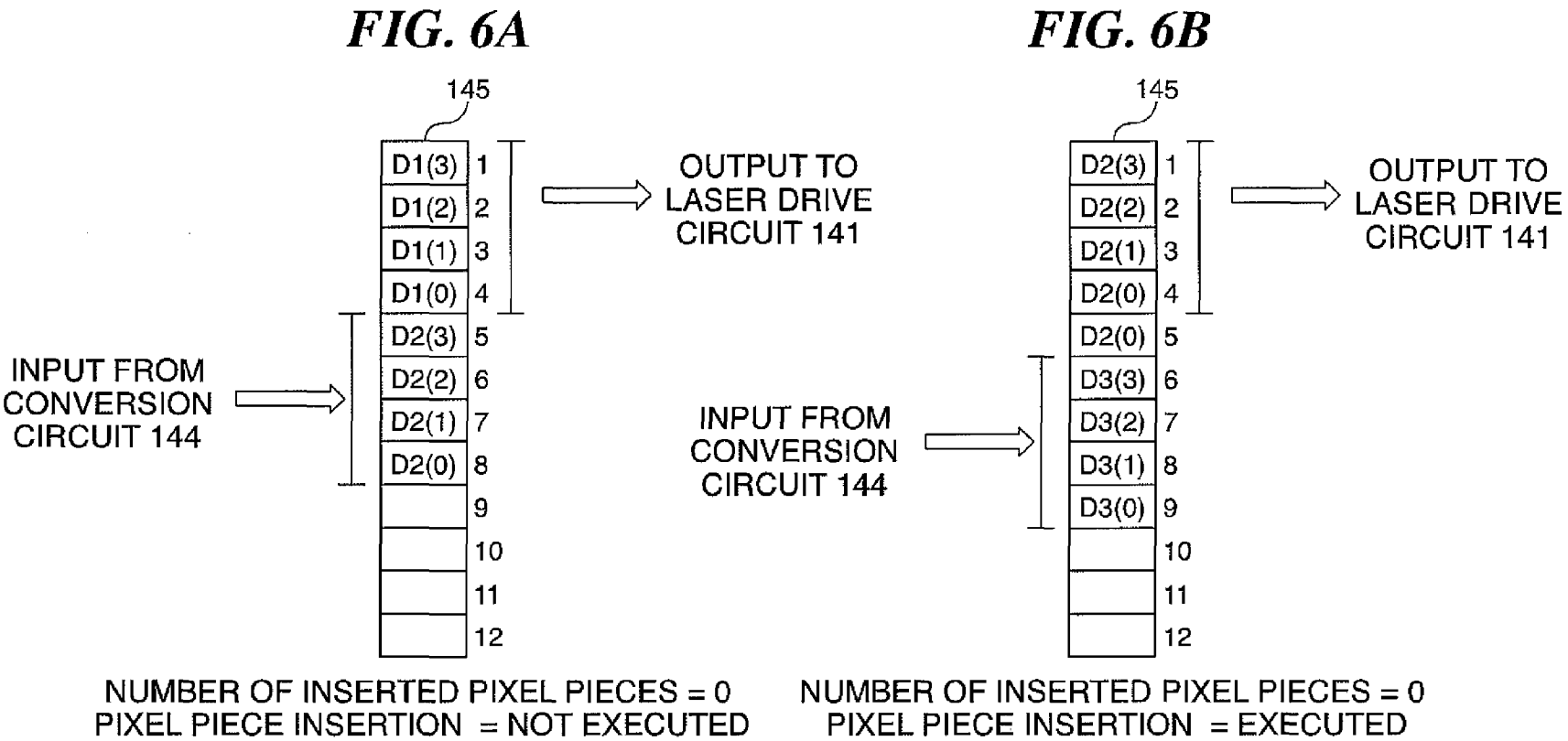

FIG. 6A: A case where no pixel piece has been inserted using the shift register 145 up to the immediately preceding operation of the PWM lighting pattern. Data of a 4-bit PWM lighting pattern output from the conversion circuit 144 are stored in addresses 5 to 8 of the shift register 145, and data D1(3 to 0) stored in addresses 1 to 4 of the shift register 145 are output to the laser drive circuit 141. After the output of the data D1(3 to 0), data items stored in addresses 5 to 12 are shifted to the addressed 1 to 8. At this time, addresses 9 to 12 are empty.

FIG. 6B: A case where no pixel piece has been inserted using the shift register 145 up to the immediately preceding operation of the PWM lighting pattern, and a pixel piece is inserted in the current operation in predetermined timing. The same data item as data D2(0) stored in the fourth address of the shift register 145 is stored in the address 5, and data D3(3 to 0) newly output from the conversion circuit 144 are stored in the addresses 6 to 9, respectively. Similarly to the case illustrated in FIG. 6A, data D2(3 to 0) stored in the addresses 1 to 4 of the shift register 145 are output to the laser drive circuit 141. After the output of the data D2(3 to 0), data items stored in the addresses 5 to 12 are shifted to the addressed 1 to 8.

Figures 6C, 6D:
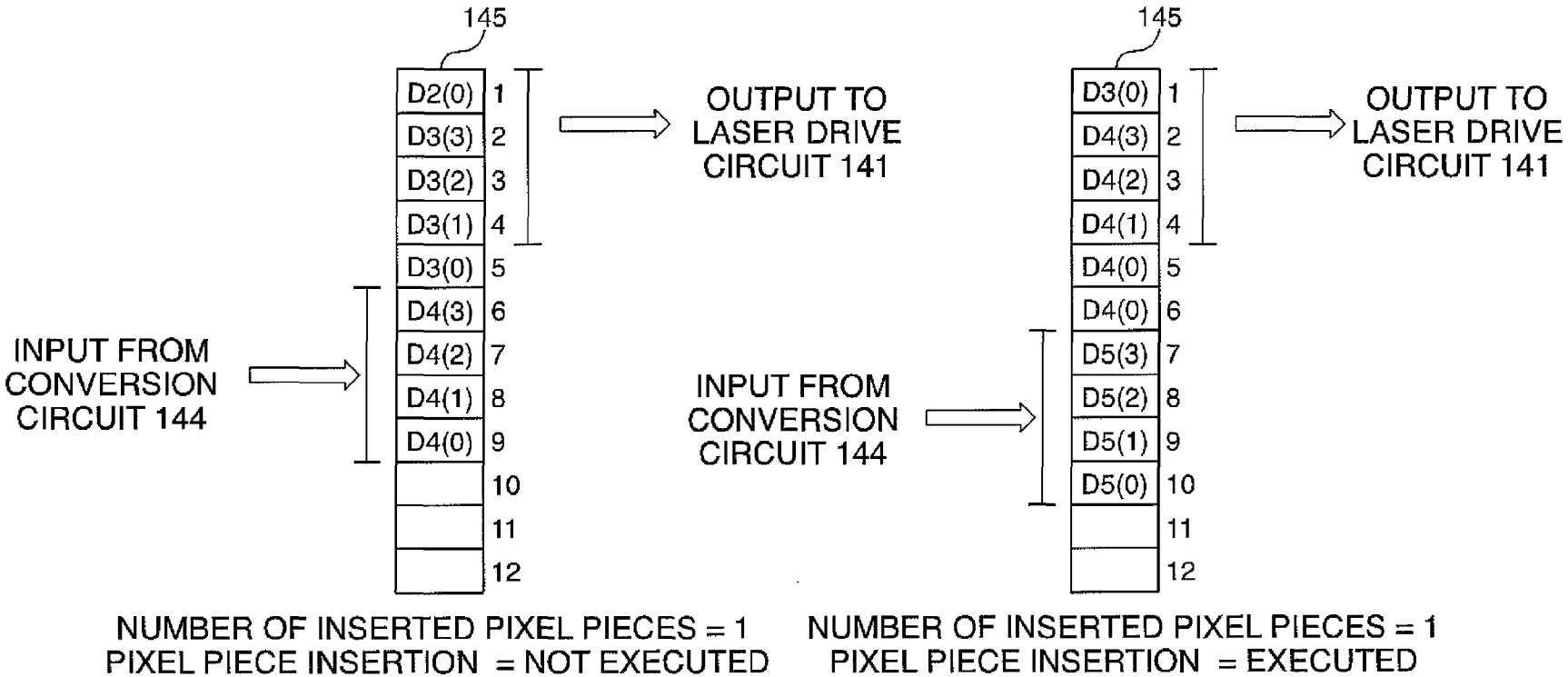
Figures 6E, 6F:
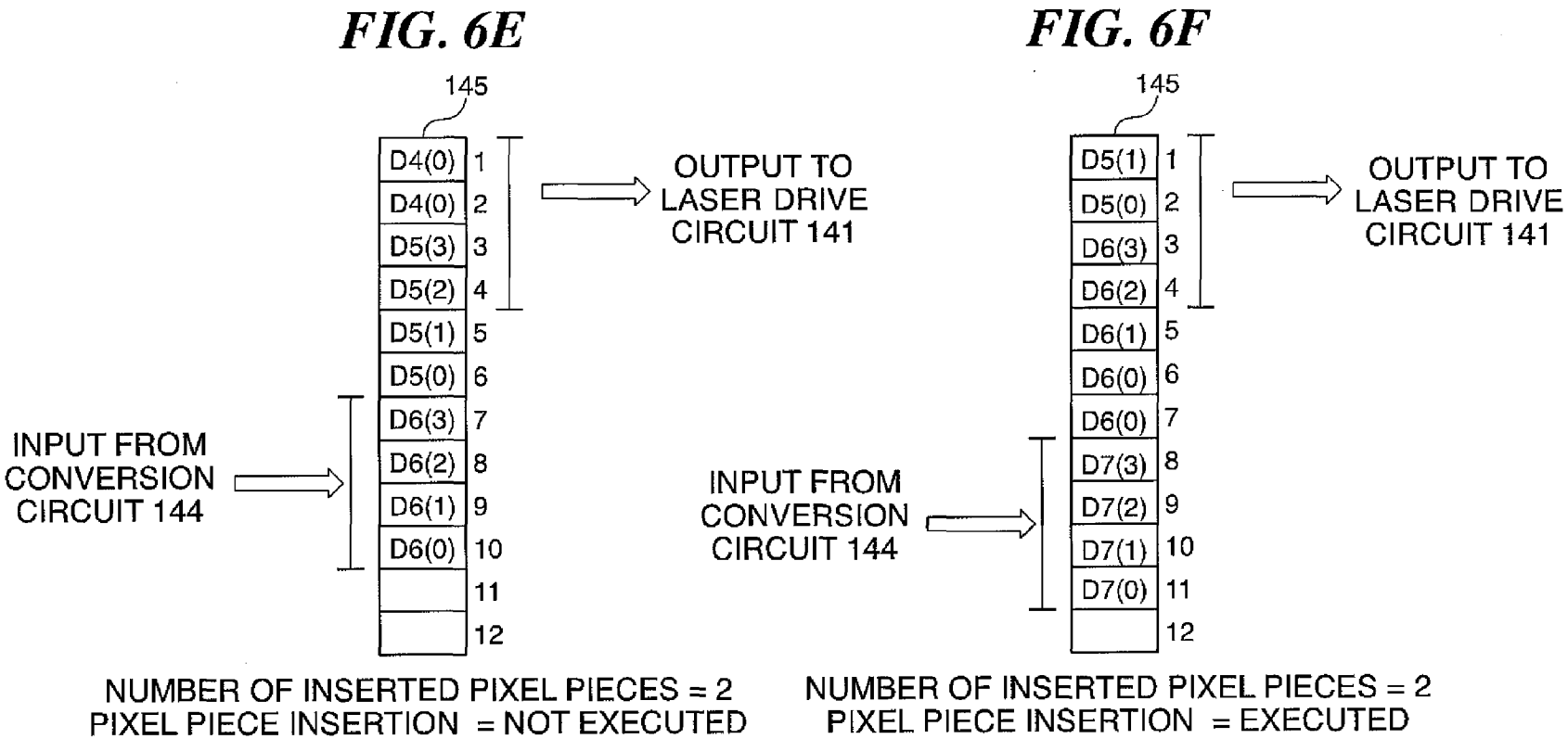

FIG. 6C: A case where one pixel piece has been inserted using the shift register 145 up to the immediately preceding operation of the PWM lighting pattern, and no pixel piece is inserted using the shift register 145 in the current operation. New data D4(3 to 0) are stored in the addresses 6 to 9 of the shift register 145, and the copied and inserted data D2(0) and the data 3(3 to 1) are output to the laser drive circuit 141. After the output of the data D2(0) and the data 3(3 to 1), similarly to the above-described cases, the remaining data are shifted to the upper addresses by four addresses.

FIG. 6D: A case where one pixel piece has been inserted using the shift register 145 up to the immediately preceding operation of the PWM lighting pattern, and a pixel piece is inserted using the shift register 145 in the current operation. The same data item as data D4(0) stored in the fifth address of the shift register 145 is stored in the address 6, and new data D5(3 to 0) are stored in the addresses 7 to 10, respectively. The data D3(0) and D4(3 to 1) are output to the laser drive circuit 141. After the output of the data D3(0) and D4(3 to 1), similarly to the above-described cases, the remaining data are shifted to the upper addresses by four addresses.

FIGS. 6E to 6H: Similarly to the above-described cases, as a pixel piece is inserted, the PWM lighting pattern output from the conversion circuit 144 is input to displaced positions in the shift register 145. When a pixel piece is inserted immediately after the FIG. 6H operation, the shift register 145 is overflowed with data, so that if the shift register 145 is placed in the state illustrated in FIG. 6H, one-time output of the memory 143 is stopped. After that, the shift register 145 returns from the FIG. 6H state to the FIG. 6A state, and the same operations as described above are repeatedly carried out therefrom.

It should be noted that although in the above-described embodiment, the shift register 145 capable of storing three pixels is assumed to be employed, and output of data items from the memory 143 is limited such that the shift register 145 is prevented from being overflowed with the data, by way of example, this is not limitative, but a shift register (for four or more pixels) that is made longer according to the number of pixel pieces inserted using the shift register 145 may be employed.

Further, although in the above-described embodiment, the same data item as stored in the immediately preceding location of the shift register 145 with respect to an inserting location for pixel piece is additionally stored in the inserting location, by way of example, this is not limitative, but the same data item as stored in the immediately following location of the shift register 145 with respect to the inserting location may be stored in the same. Further, a fixed value may be inserted as a pixel piece. Further, a plurality of pixel pieces may be inserted. Inversely, the shift register 145 may be configured such that a pixel piece therein is removed (deleted).

Further, although in the above-described embodiment, a pixel piece is inserted before the one-pixel lighting pattern which is input from the conversion circuit 144 to the shift register 145, by way of example, this is not limitative, but a pixel piece may be inserted after the one-pixel lighting pattern which is input. Inversely, the shift register 145 may be configured such that a pixel piece therein is removed (deleted) from the input one-pixel lighting pattern.

Figure 7A:
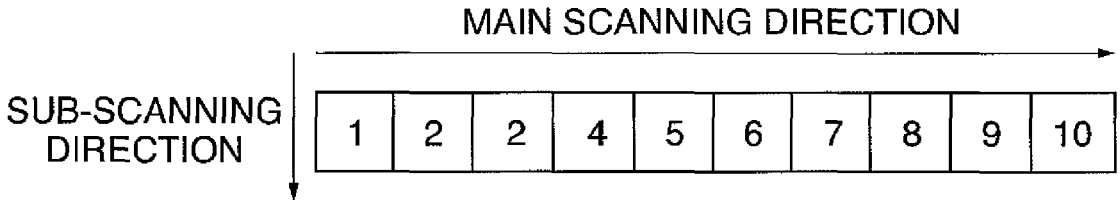
FIG. 7A is a view showing a state of 10 pixels formed in the main scanning direction by monochrome printing.
Figure 7B:
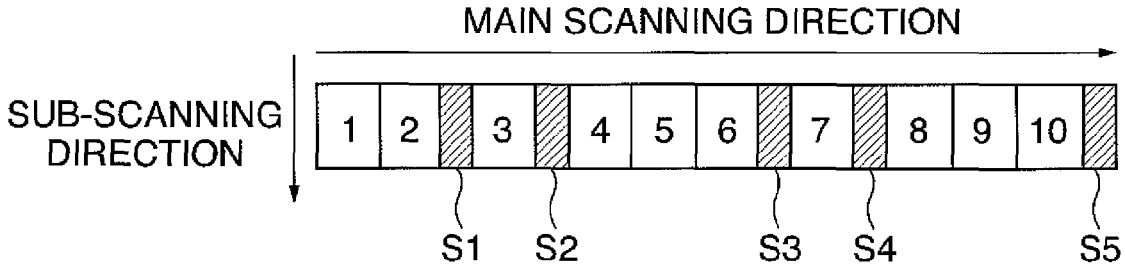
FIG. 7B is a view showing a state of 10 pixels formed in the main scanning direction by executing pixel piece insertion using the shift register during color printing.

FIGS. 7A and 7B are views showing states of 10 pixels formed in the main scanning direction when pixel pieces are inserted using the shift register 145, in which FIG. 7A shows a state of the pixels formed by monochrome printing (BW print), and FIG. 7B shows a state of the pixels formed by executing pixel piece insertion using the shift register during color printing.

In FIGS. 7A and 7B, it is assumed that the image clock of the image forming apparatus is set according to the monochrome printing the image forming speed (processing speed) of which is relatively high. In the monochrome printing shown in FIG. 7A, the rotational speed of the polygon motor of the laser scanner unit 13 (the interval of the BD signal) is set, whereby it is possible to obtain an image with a resolution of 600 dpi in the sub-scanning direction. A resolution of 600 dpi in the main scanning direction can be realized by the frequency of the image clock calculated by setting the rotational speed of the polygon motor.

In the color printing shown in FIG. 7B, by setting the rotational speed of the polygon motor, it is possible to obtain an image with a resolution of 600 dpi in the sub-scanning direction. As for the resolution of the image in the main scanning direction is 600 dpi, however, the width of each pixel becomes narrower than in the resolution of 600 dpi in the monochrome printing, since the image clock is set according to the monochrome printing the image forming speed of which is higher than that of the color printing.

To solve the problem, in the present embodiment, the difference between the image forming speed of the monochrome printing (first image forming speed) and the image forming speed of the color printing (second image forming speed) is calculated, and the amount of narrowing of the width of a pixel is calculated based on the calculated difference between the image forming speeds. Further, the amount of insertion of pixel pieces is determined based on the calculated amount of narrowing of the pixel width, and pixel piece insertion is performed using the shift register 145 as indicated by steps S1 to S5 in FIG. 7B. This makes it possible to realize an image with the resolution of 600 dpi in the main scanning direction.

Let it be assumed, for example, that the productivity (the number of sheets printed per minute) of the image forming apparatus that performs image formation on A4-sized recording sheets is 32 (sheets/min) in the monochrome printing, and is 30 (sheets/min) in the color printing. In this case, the width of each pixel in the main scanning direction in the monochrome printing is equal to 42.3 μm since the image clock is calculated and set based on the image forming speed of the monochrome printing. In contrast, in the color printing, the width of each pixel in the main scanning direction is equal to 39.7 μm, and when image formation is performed on A4-sized recording sheets, an image is formed which is reduced in size by 1.56 mm in the main scanning direction.

To solve this problem, pixel pieces corresponding in total to a length of 1.56 mm in the main scanning direction are inserted in the shift register 145, thereby making it possible to form an image with the resolution of 600 dpi in the main scanning direction also in the color printing. Further, if positions where a necessary number of pixel pieces are to be inserted are determined using random numbers, it is possible to form an image free from bias.

Figure 8:
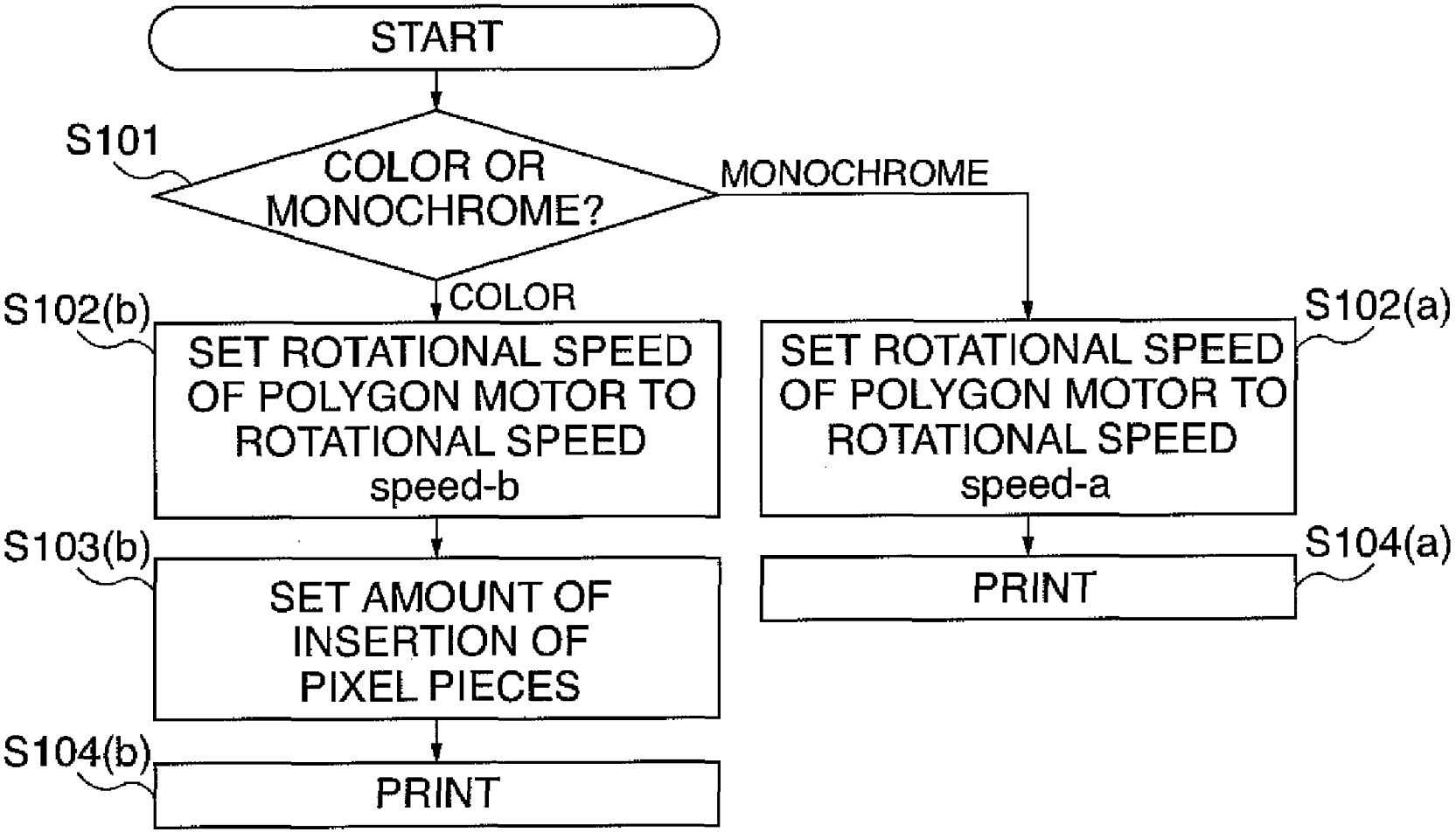
FIG. 8 is a flowchart of an image forming process executed by the image forming apparatus according to the first embodiment.

FIG. 8 is a flowchart of an image forming process executed by the image forming apparatus according to the present embodiment.

Referring to FIG. 8, when a print job for performing image formation on a recording sheet is input, the controller 50-1 of the control unit 50 determines which of the monochrome printing and the color printing is required to be performed (step S101). The image forming speed is different depending on the kind of printing, and hence to realize the resolution of 600 dpi in the sub-scanning direction, the controller 50-1 sets the rotational speed of the polygon motor according to the kind of printing. More specifically, when the monochrome printing is to be performed, the rotational speed of the polygon motor is set to a rotational speed speed-a (step S102(*a*)), whereas when the color printing is to be performed, the rotational speed of the polygon motor is set to a rotational speed speed-b (step S102(*b*)).

When the monochrome printing is performed, the controller 50-1 sets the rotational speed of the polygon motor as described above, thereby enabling the image forming section 10 to realize the resolution of 600 dpi in the sub-scanning direction and the resolution of 600 dpi in the main scanning direction (step S104(*a*)). When the color printing is performed, the controller 50-1 calculates the difference between the image forming speed of the monochrome printing and that of the color printing, and determines the amount of pixel piece insertion to be executed using the shift register 145 based on the results of the calculation (step S103(*b*)). Further, the controller 50-1 causes the image forming section 10 to perform a printing operation based on the determined amount of pixel piece insertion (step S104(*b*)).

Figure 9A:
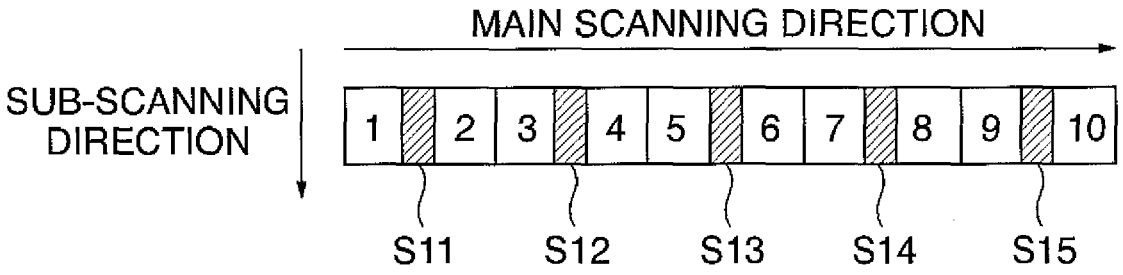
FIG. 9A is a view showing a state of 10 pixels formed in the main scanning direction by monochrome printing using an image forming apparatus according to a second embodiment of the present invention that executes pixel piece removal during monochrome printing using a shift register.
Figure 9B:
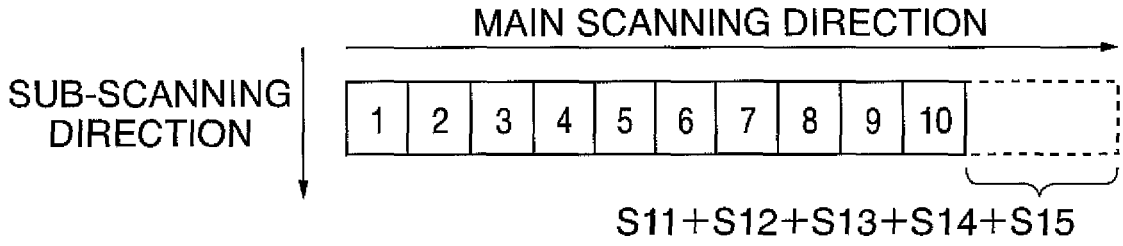
FIG. 9B is a view showing a state of 10 pixels formed in the main scanning direction by color printing using the image forming apparatus according to the second embodiment.

FIGS. 9A and 9B are views showing states of 10 pixels formed in the main scanning direction by an image forming apparatus according to a second embodiment of the present invention that executes pixel piece removal during monochrome printing using a shift register, in which FIG. 9A shows a state of 10 pixels formed by monochrome printing and FIG. 9B shows a state of 10 pixels formed by color printing. The second embodiment is distinguished from the first embodiment only in the above-mentioned operation of pixel piece insertion or pixel piece deletion performed using the shift register 145. Therefore, corresponding components of the image forming apparatus are denoted by the same reference numerals, and the duplicate description thereof is omitted.

In FIGS. 9A and 9B, it is assumed that the image clock of the image forming apparatus is set according to the color printing the image forming speed of which is lower than that of the monochrome printing. In the monochrome printing shown in FIG. 9A, by setting the rotational speed of the polygon motor of the laser scanner unit 13 (interval of the BD signal), it is possible to obtain an image having the resolution of 600 dpi in the sub-scanning direction. As for the resolution of 600 dpi in the main scanning direction, however, the width of each pixel becomes wider than in the resolution of 600 dpi in the monochrome printing, since the image clock is set according to the color printing the image forming speed of which is lower than that of the monochrome printing.

To solve the problem, in the present embodiment, the difference between the image forming speed of the monochrome printing and that of the color printing is calculated, and the amount of widening of the width of each pixel is calculated based on the calculated difference. Further, the amount of removal (deletion) of pixel pieces is determined based on the calculated amount of widening of the width of each pixel, and pixel piece removal (deletion) is performed using the shift register 145 as indicated by S11 to S15 in FIG. 9A. This makes it possible to realize an image with the resolution of 600 dpi in the main scanning direction.

For example, let it be assumed, for example, that the productivity (the number of sheets printed per minute) of the image forming apparatus that performs image formation on A4-sized recording sheets is 32 (sheets/min) in the monochrome printing, and is 30 (sheets/min) in the color printing, the width of each pixel in the main scanning direction in the color printing is equal to 42.3 μm since the image clock is calculated and set based on the image forming speed. In contrast, in the monochrome printing, the width of each pixel in the main scanning direction is equal to 45.1 μm, and when image formation is performed on A4-sized recording sheets, an image is formed which is increased in size by 1.68 mm in the main scanning direction.

To solve this problem, pixel pieces corresponding in total to a length of 1.68 mm are removed using the shift register 145, thereby making it possible to form an image with the resolution of 600 dpi in the main scanning direction also in the color printing. Further, if positions from which a necessary number of pixel pieces are to be removed are determined using random numbers, it is possible to form an image free from bias.

In the color printing shown in FIG. 9B, by setting the rotational speed of the polygon motor, it is possible to obtain an image with the resolution of 600 dpi in the sub-scanning direction. Further, the resolution of 600 dpi in the main scanning direction can be realized by the frequency of the image clock that is calculated from the setting of the rotational speed of the polygon motor.

Figure 10:
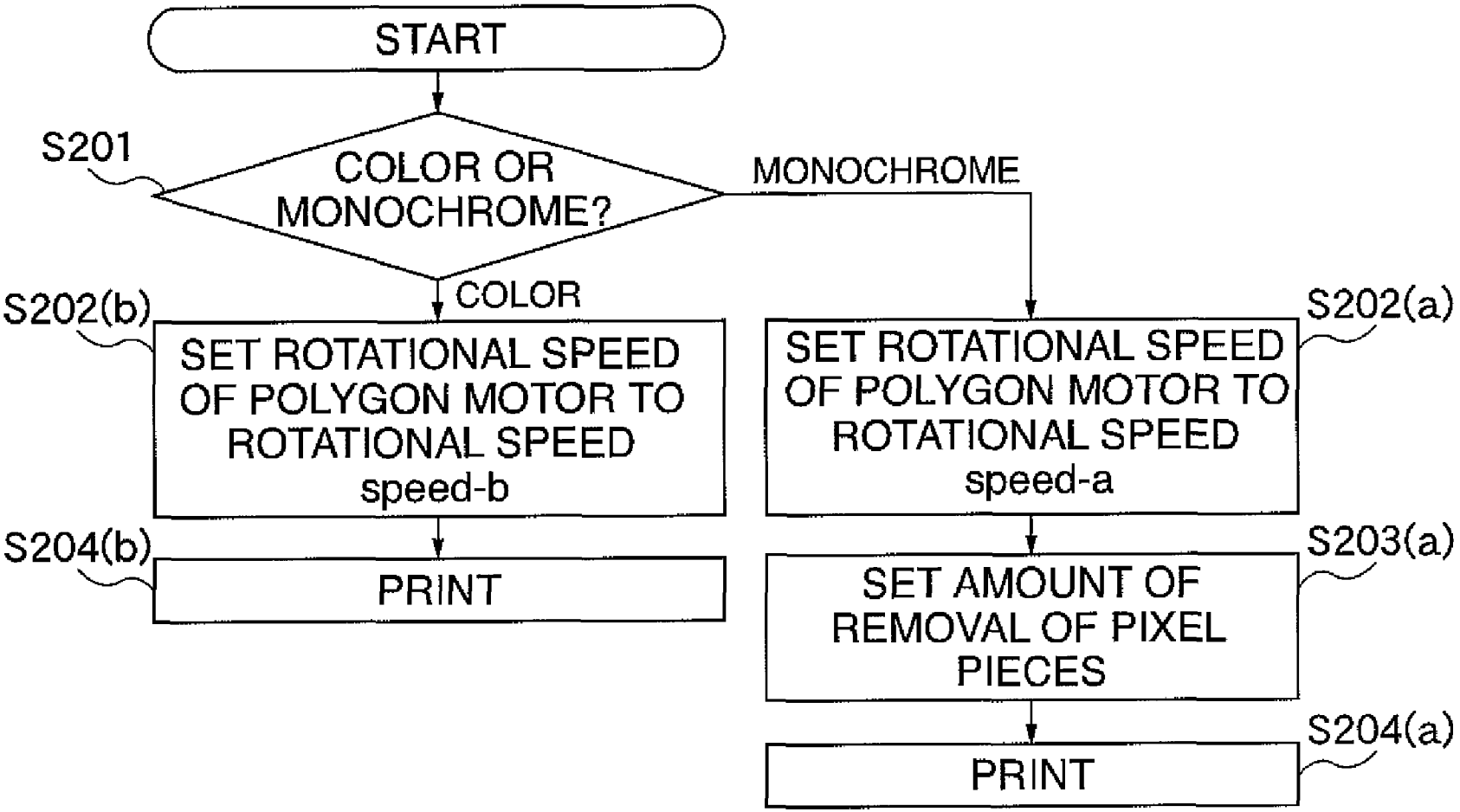
FIG. 10 is a flowchart of an image forming process executed by the image forming apparatus according to the second embodiment.

FIG. 10 is a flowchart of an image forming process executed by the image forming apparatus according to the present embodiment.

Referring to FIG. 10, when a print job for performing image formation on recording sheets is input, the controller 50-1 of the control unit 50 determines which of the monochrome printing and the color printing is required to be performed (step S201). The image forming speed is different depending on the kind of printing, and hence to realize the resolution of 600 dpi in the sub-scanning direction, the controller 50-1 sets the rotational speed of the polygon motor according to the kind of printing. More specifically, when the monochrome printing is to be performed, the rotational speed of the polygon motor is set to a rotational speed speed-a (step S202(*a*)), whereas when the color printing is to be performed, the rotational speed of the polygon motor is set to a rotational speed speed-b (step S202(*b*)).

When the monochrome printing is performed, the controller 50-1 calculates the difference between the image forming speed of the monochrome printing and that of the color printing, and determines the amount of removal of pixel pieces to be executed using the shift register 145 based on the results of the calculation (step S203(*a*)). Further, the controller 50-1 causes the image forming section 10 to perform a printing operation based on the determined amount of removal of pixel pieces (step S204(*a*). When the color printing is performed, the controller 50-1 sets the rotational speed of the polygon motor as described above, thereby enabling the image forming section 10 to realize the resolution of 600 dpi in the sub-scanning direction and the resolution of 600 dpi in the main scanning direction (step S204(*b*)).

Figure 11A:
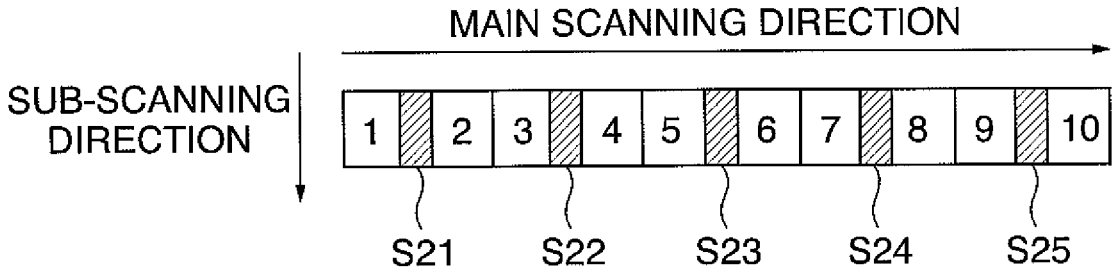
FIG. 11A is a view showing a state of 10 pixels formed in the main scanning direction by monochrome printing using an image forming apparatus according to a third embodiment of the present invention that executes pixel piece removal during monochrome printing and pixel piece insertion during color printing using a shift register.
Figure 11B:
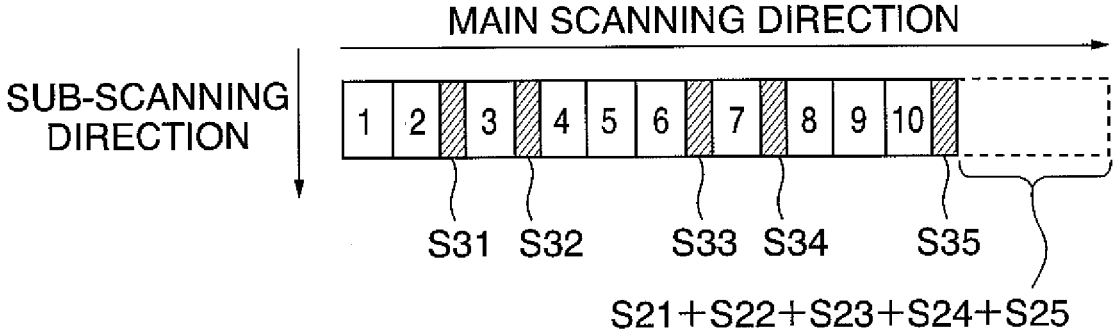
FIG. 11B is a view showing a state of 10 pixels formed in the main scanning direction by color printing using the image forming apparatus according to the third embodiment.

FIGS. 11A and 11B are views showing states of 10 pixels formed in the main scanning direction by an image forming apparatus according to a third embodiment of the present invention that executes pixel piece removal during monochrome printing and pixel piece insertion during color printing, using a shift register, in which FIG. 11A shows a state of 10 pixels formed by monochrome printing, and FIG. 11B shows a state of 10 pixels formed by color printing. The third embodiment is distinguished from the first and second embodiments only in the above-mentioned operation of pixel piece insertion or pixel piece deletion performed using the shift register. Therefore, corresponding components of the image forming apparatus are denoted by the same reference numerals, and the duplicate description thereof is omitted.

In FIGS. 11A and 11B, the image clock, generated from the clock generating circuit 142 of the modulator 138 is assumed to be set such that an image with the resolution of 600 dpi in the main scanning direction can be formed at an image forming speed (third image forming speed) between the high image forming speed (first image forming speed) of the monochrome printing and the low image forming speed (second image forming speed) of the color printing. In short, the image clock is set such that it is capable of forming an image on the image forming section 10 at the third image forming speed.

In the monochrome printing shown in FIG. 11A, by setting the rotational speed of the polygon motor, it is possible to obtain an image with the resolution of 600 dpi in the sub-scanning direction. As for the resolution of the image in the main scanning direction is 600 dpi, however, the width of each pixel becomes wider than in the resolution of 600 dpi in the color printing, due to the difference between the image forming speed of the monochrome printing and the image forming speed set based on the above-mentioned image clock.

To solve the problem, in the present embodiment, the difference between the image forming speed of the monochrome printing and the image forming speed set based on the above-mentioned image clock is calculated, and the amount of widening of the width of each pixel is calculated based on the calculated difference. Further, the amount of removal (deletion) of pixel pieces is determined based on the calculated amount of widening of the pixel width, and pixel piece removal (deletion) is performed using the shift register 145 as indicated by S21 to S25 in FIG. 11A. This makes it possible to realize an image with the resolution of 600 dpi in the main scanning direction.

In the color printing shown in FIG. 11B, by setting the rotational speed of the polygon motor, it is possible to obtain an image with the resolution of 600 dpi in the sub-scanning direction. As for the resolution of the image in the main scanning direction is 600 dpi, however, the width of each pixel becomes narrower than in the resolution of 600 dpi in the monochrome printing, due to the difference between the image forming speed of the color printing and the image forming speed set based on the above-mentioned image clock.

To solve the problem, in the present embodiment, the difference between the image forming speed set based on the above-mentioned image clock and the image forming speed of the color printing is calculated, and the amount of narrowing of the width of each pixel is calculated based on the calculated difference. Further, the amount of insertion of pixel pieces is determined based on the calculated amount of narrowing of the pixel width, and pixel piece insertion is performed using the shift register 145 as indicated by S31 to S35 in FIG. 11B. This makes it possible to realize an image with the resolution of 600 dpi in the main scanning direction.

For example, when the productivity (the number of sheets printed per minute) of the image forming apparatus that performs image formation on A4-sized recording sheets is 40 (sheets/min) in the monochrome printing, and is 30 (sheets/min) in the color printing, and further when the image clock is set such that an image with the resolution of 600 dpi in the main scanning direction is formed at an image forming speed of 35 (sheets/min), the width of each pixel in the main scanning direction in the monochrome printing is equal to 48.3 μm due to the difference between the image forming speed associated with the image clock and the image forming speed in the monochrome printing. When the image formation is performed on A4-sized recording sheets, an image is formed which is increased in size by 3.6 mm in the main scanning direction.

Therefore, if pixel pieces corresponding in total to a length of 3.6 mm are removed using the shift register 145, it is possible to form an image with the resolution of 600 dpi in the main scanning direction by performing the monochrome printing.

Next, in the color printing, the width of each pixel in the main scanning direction is equal to 36.3 μm due to the difference between the image forming speed set based on the image clock and the image forming speed in the color printing. When the image formation is performed on A4-sized recording sheets, an image is formed which is reduced in size by 3.6 mm in the main scanning direction.

To solve this problem, pixel pieces corresponding to 3.6 mm are inserted using the shift register 145, thereby making it possible to form an image with the resolution of 600 dpi in the main scanning direction also in the color printing. Further, if positions into which a necessary number of pixel pieces are to be inserted and positions from which a necessary number of pixel pieces are to be removed are determined using random numbers, it is possible to form an image free from bias.

Figure 12:
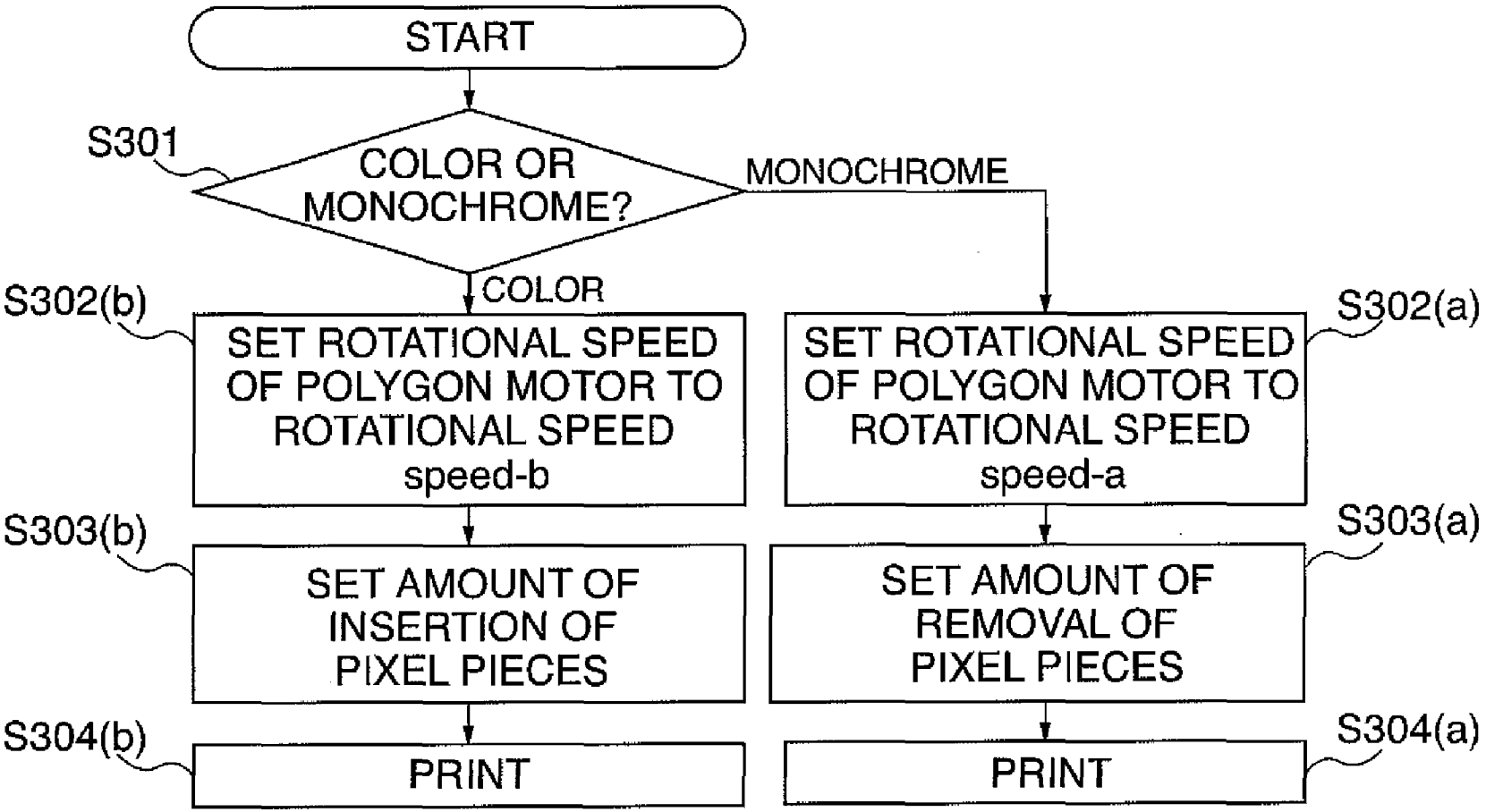
FIG. 12 is a flowchart of an image forming process executed by the image forming apparatus according to the third embodiment.
Figure 13:
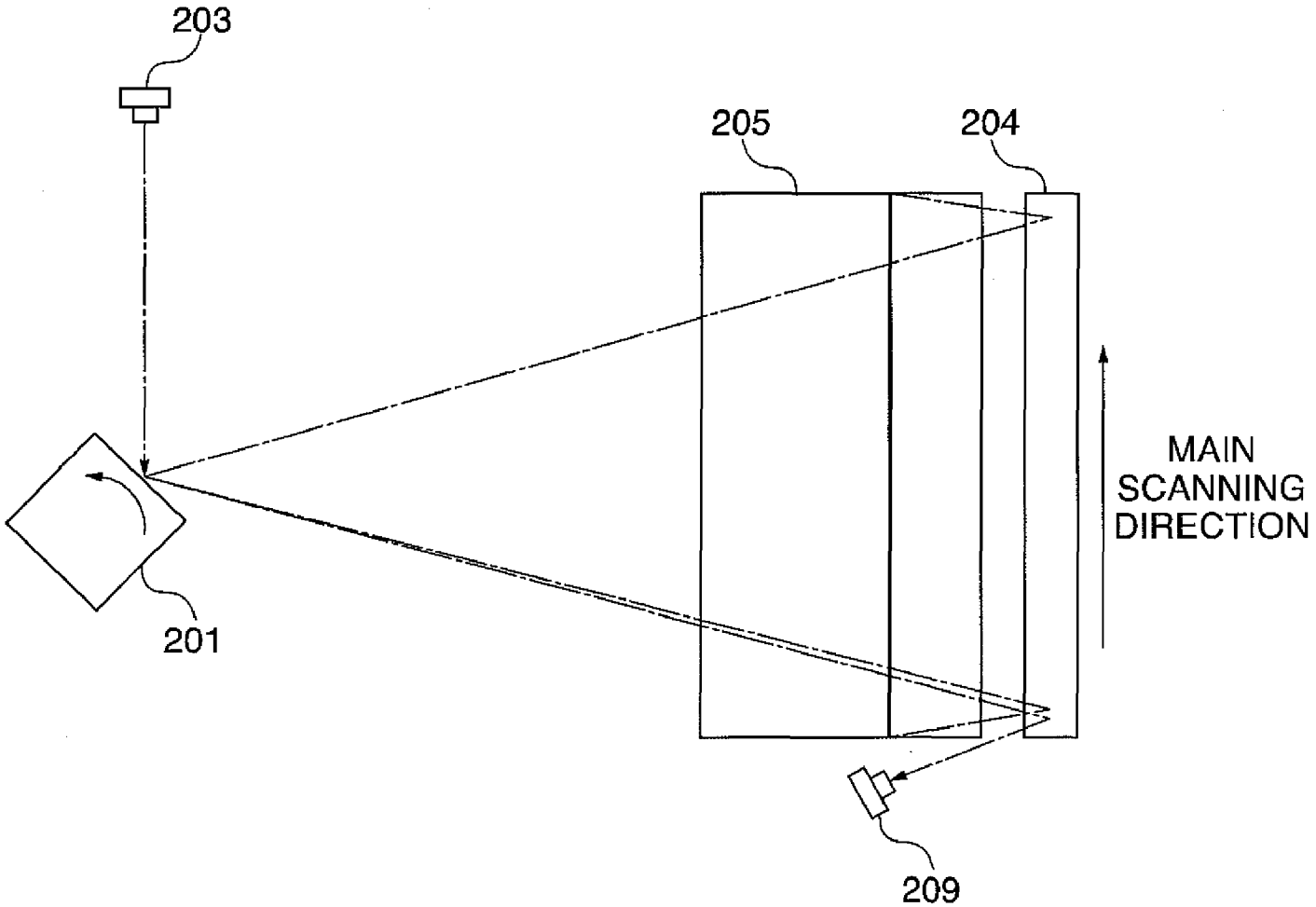
FIG. 13 is a plan view of an image forming section according to the prior art.
Figure 14:
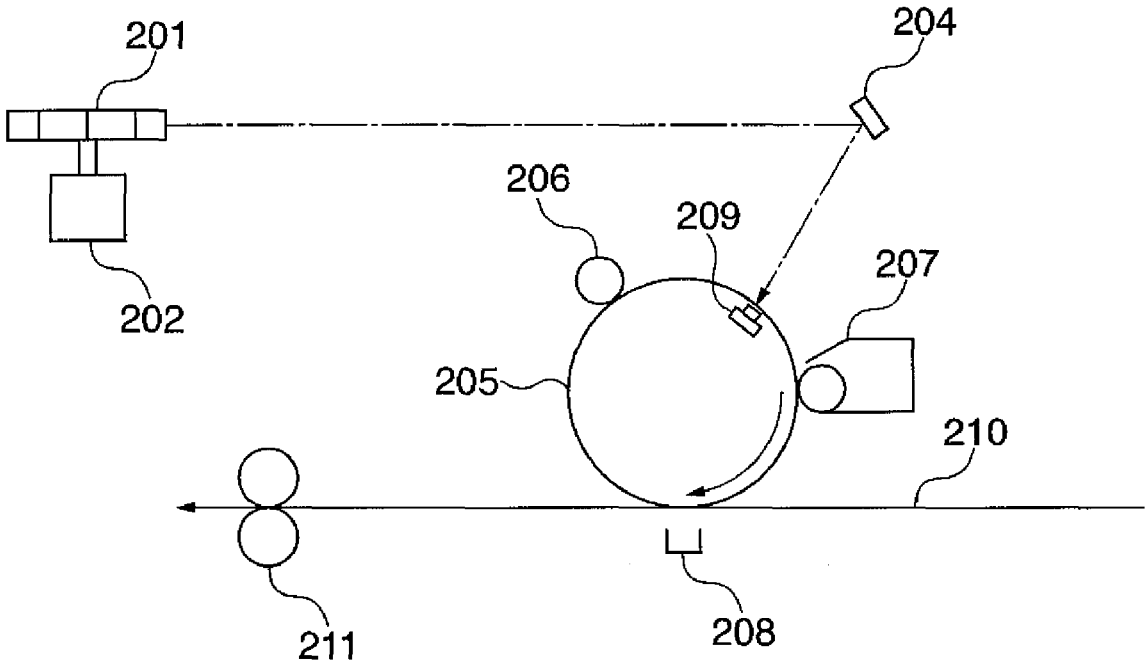
FIG. 14 is a side view of the image forming section.
Figure 15A:
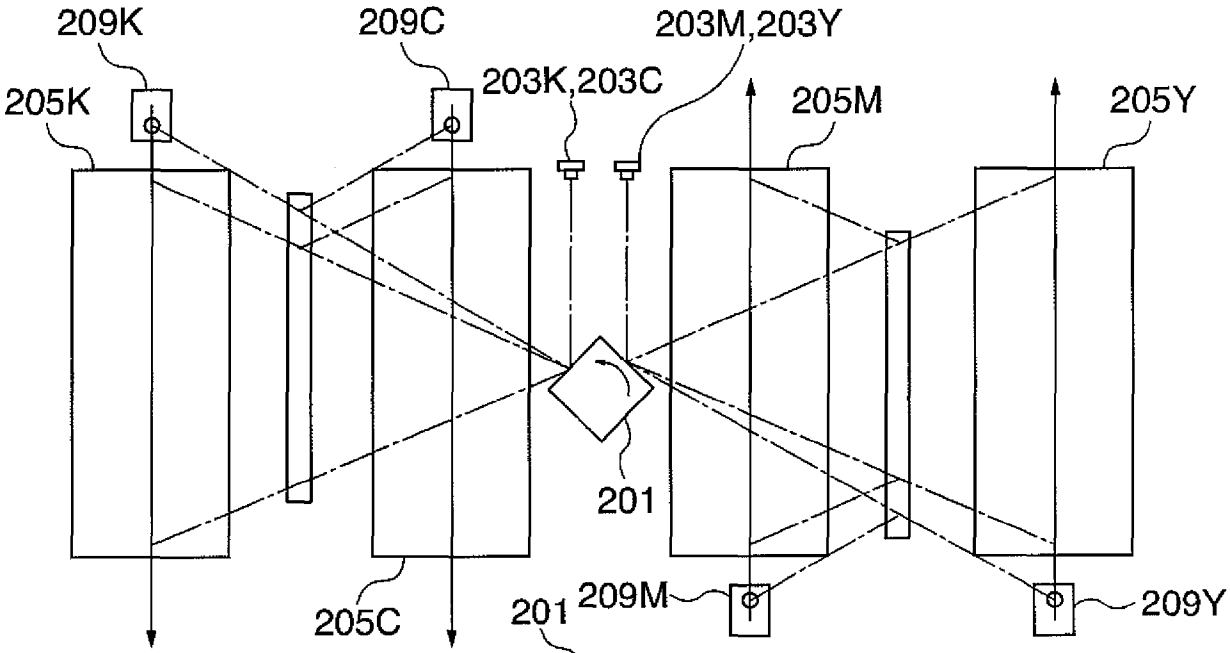
FIG. 15 is a schematic view of image forming sections for respective colors.
Figure 15B:
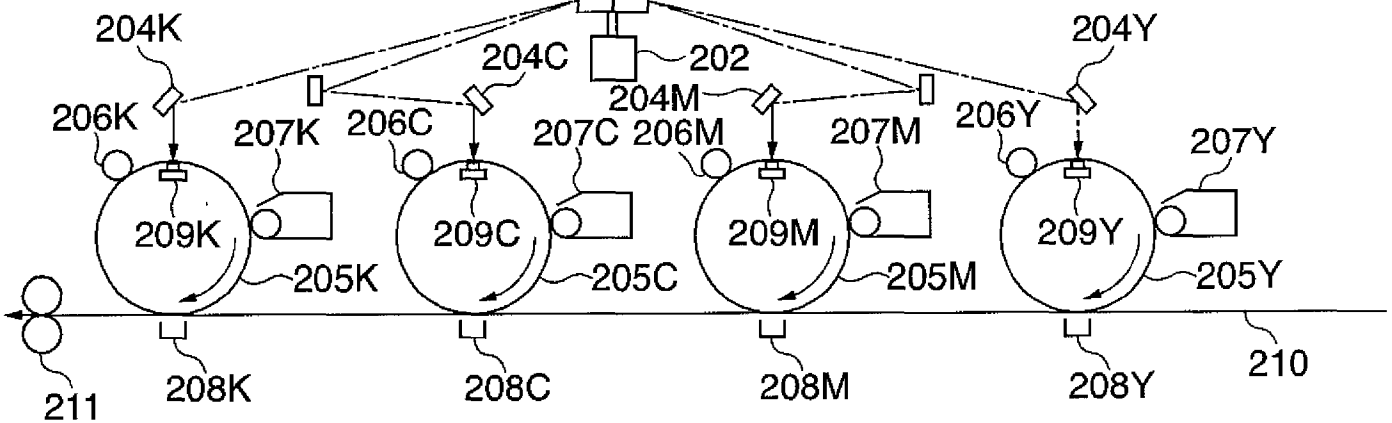
Figure 17A:
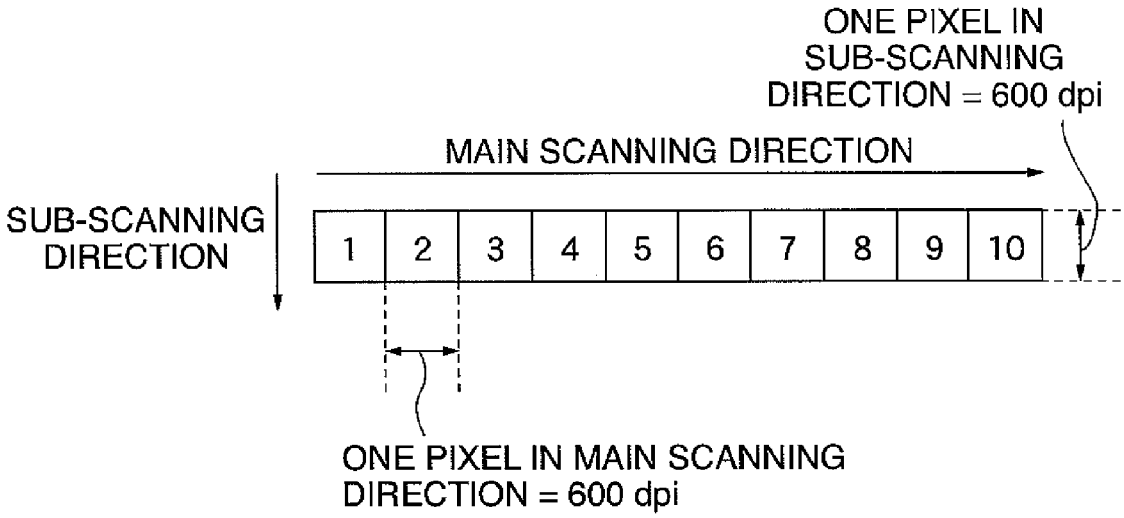
FIG. 17A is a view showing a state of 10 pixels formed in the main scanning direction by monochrome printing according to a conventional image forming process.
Figure 17B:
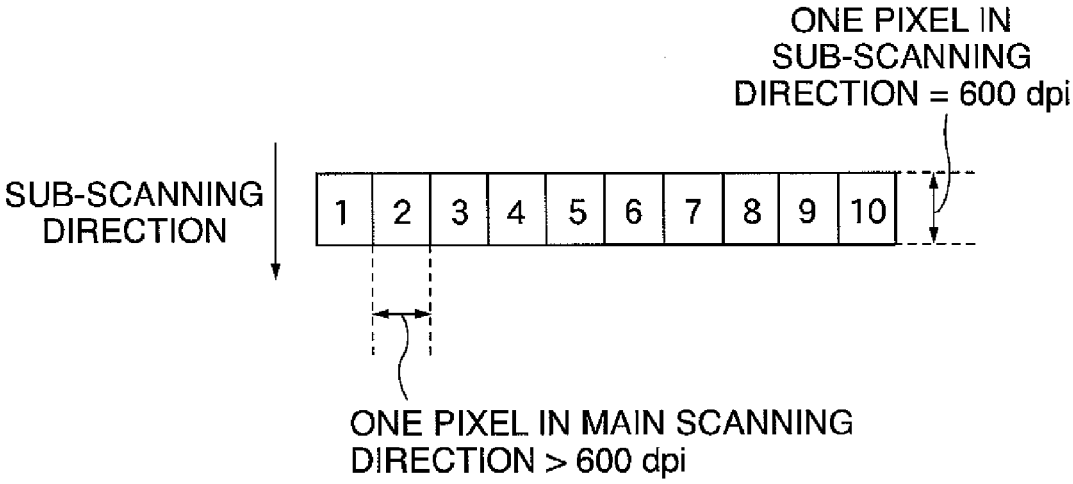
FIG. 17B is a view showing a state of 10 pixels formed in the main scanning direction by color printing according to the conventional image forming process.
Figure 18A:
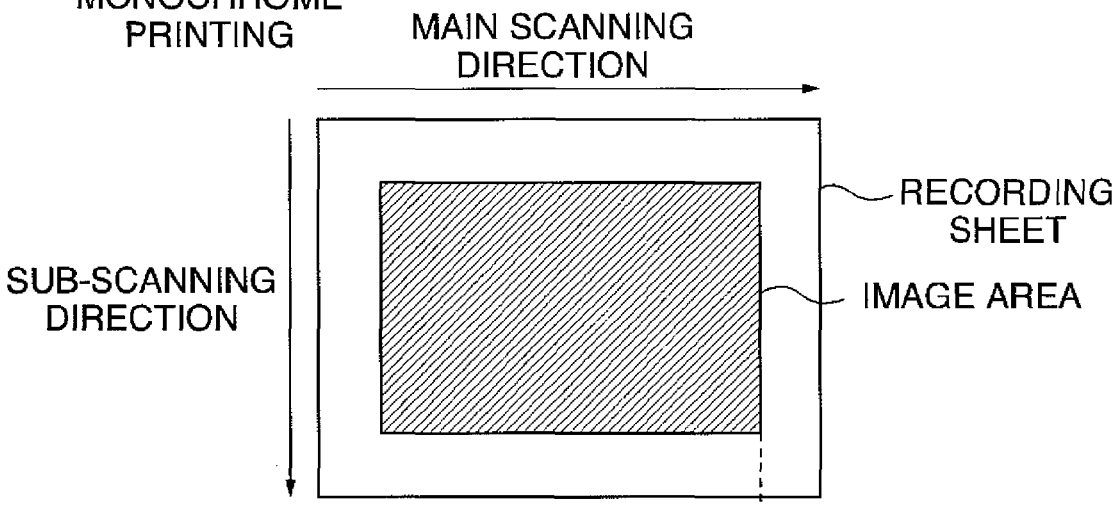
FIG. 18A is a view showing the relationship between a recording sheet and an area of an image formed by monochrome printing according to the conventional image forming process.
Figure 18B:
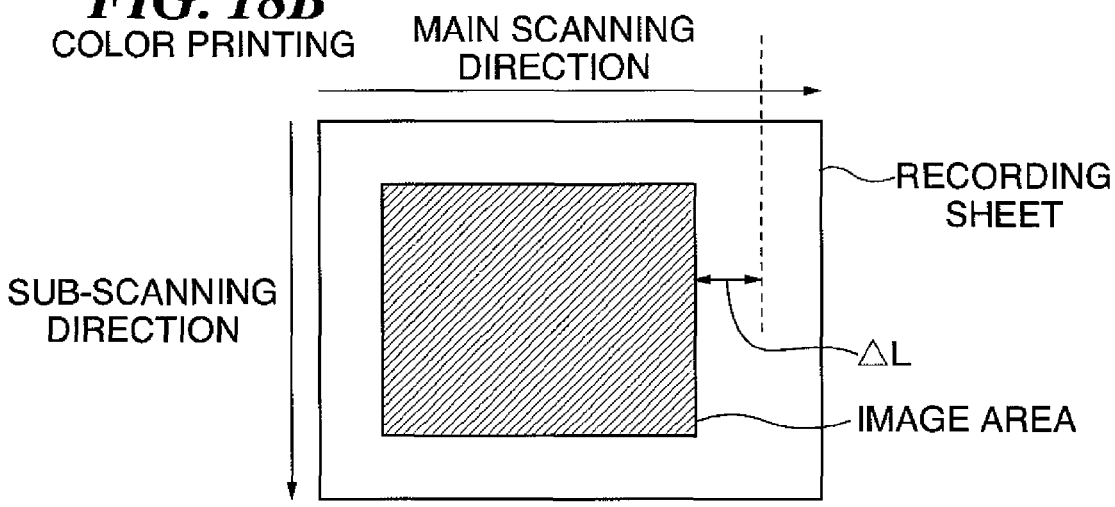
FIG. 18B is a view showing the relationship between a recording sheet and an area of an image formed by color printing according to the conventional image forming process.

FIG. 12 is a flowchart of an image forming process executed by the image forming apparatus according to the third embodiment.

As shown in FIG. 12, when a print job for performing image formation on recording sheets is input, the controller 50-1 of the control unit 50 determines which of the monochrome printing and the color printing is required to be performed (step S301). The image forming speed is different depending on the kind of printing, and hence to realize the resolution of 600 dpi in the sub-scanning direction, the controller 50-1 sets the rotational speed of the polygon motor according to the kind of printing. More specifically, when the monochrome printing is performed, the rotational speed of the polygon motor is set to a rotational speed speed-a (step S302(*a*)), whereas when the color printing is to be performed, the rotational speed of the polygon motor is set to a rotational speed speed-b (step S302(*b*)).

When the monochrome printing is performed, the controller 50-1 calculates the difference between the image forming speed of the monochrome printing and the image forming speed set based on the aforementioned image clock, and determines the amount of removal of pixel pieces to be executed using the shift register 145 based on the results of the calculation (step S303(*a*)). Further, the controller 50-1 causes the image forming section 10 to perform a printing operation based on the determined amount of removal of pixel pieces (step S304(*a*). This makes it possible to form an image with the resolution of 600 dpi in the main scanning direction and the resolution of 600 dpi in the sub-scanning direction.

When the color printing is performed, the controller 50-1 calculates the difference between the image forming speed of the color printing and the image forming speed set based on the above-mentioned image clock, and determines the amount of insertion of pixel pieces to be executed using the shift register 145 based on the results of the calculation (step S303(*b*)). Further, the controller 50-1 causes the image forming section 10 to perform a printing operation based on the determined amount of insertion of pixel pieces (step S304(*b*)). This makes it possible to form an image with the resolution of 600 dpi in the main scanning direction and the resolution of 600 dpi in the sub-scanning direction.

As described hereinabove, according to the above-described embodiments, the amount of insertion of pixel pieces or the amount of removal of pixel pieces is determined based on the difference between the image forming speed of the monochrome printing and that of the color printing. Alternatively, the amount of removal of pixel pieces is determined based on the difference between the image forming speed of the monochrome printing and the image forming speed set based on the image clock, and the amount of insertion of pixel pieces is determined based on the difference between the image forming speed of the color printing and the image forming speed set based on the image clock. This makes it possible to perform image formation using one image clock at a plurality of image forming speeds, thereby making it possible to construct an image forming apparatus operable at a plurality of image forming speeds at low costs without adding circuits or the like.

Although in each of the above-described embodiments, the description has been given of the image forming apparatus operable at two image forming speeds provided for the monochrome printing and the color printing, respectively, by way of example, this is not limitative, but an image forming apparatus operable at three or more image forming speeds can obtain the same advantageous effects, by determining the amount of insertion of pixel pieces or the amount of removal of pixel pieces based on the difference between an image forming speed set based on an image clock used as a reference and an image forming speed to be compared therewith.

Although in the above-described embodiment, an electrophotographic copying machine is employed as the image forming apparatus, by way of example, this is not limitative, but the present invention can be applied to an electrophotographic printer or facsimile apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-302981 filed Nov. 22, 2007, which is hereby incorporated by reference herein in its entirety.

What is claimed is:

1. An image forming apparatus including an image forming unit that forms an image on a recording medium based on image data by emitting a laser beam from a laser light source onto a photosensitive member to form a latent image thereon and visualizing the latent image formed on the photosensitive member, comprising:

a conversion unit configured to convert the image data into lighting patterns for turning on and off the laser light source on a basis of each of auxiliary pixels formed by dividing each pixel as an image forming element;

a storage unit configured to sequentially store lighting patterns each for one pixel from said conversion unit, and sequentially output the lighting patterns to said image forming unit, said storage unit being configured to accumulate the lighting patterns for a plurality of pixels;

a storage control unit configured to perform control, when a lighting pattern for one pixel is stored from said conversion unit into said storage unit, such that an auxiliary pixel is added to the one pixel;

a calculation unit configured to calculate a difference between a first image forming speed at which image formation is performed by said image forming unit, and a second image forming speed at which image formation is performed by said image forming unit and which is lower than the first image forming speed; and a determination unit configured to determine an amount of addition of auxiliary pixels to be performed using said storage unit based on the difference calculated by said calculation unit, wherein the first image forming speed is for forming a monochrome image, whereas the second image forming speed is for forming a color image.

2. The image forming apparatus according to claim 1, including a drive unit configured to drive the laser light source, on an auxiliary pixel-by-auxiliary pixel basis, a generating unit configured to generate a clock on a pixel-by-pixel basis, and a memory unit configured to output the image data to said conversion unit in synchronism with the clock generated by said generating unit.

3. A method of controlling an image forming apparatus including an image forming unit that forms an image on a recording medium based on image data by emitting a laser beam from a laser light source onto a photosensitive member to form a latent image thereon and visualizing the latent image formed on the photosensitive member, comprising:

converting the image data into lighting patterns for turning on and off the laser light source on a basis of each of auxiliary pixels formed by dividing each pixel as an image forming element;

performing, when a lighting pattern for one pixel is stored into a storage unit, control such that an auxiliary pixel is added to the one pixel, the storage unit being configured to sequentially store lighting patterns converted from the image data each for one pixel, and sequentially output the lighting patterns to the image forming unit, the storage unit being configured to accumulate the lighting patterns for a plurality of pixels;

calculating a difference between a first image forming speed at which image formation is performed by the image forming unit, and a second image forming speed at which image formation is performed by the image forming unit and which is lower than the first image forming speed; and determining an amount of addition of auxiliary pixels to be performed using the storage unit based on the calculated difference, wherein the first image forming speed is for forming a monochrome image, whereas the second image forming speed is for forming a color image.

4. The method of controlling the image forming apparatus according to claim 3, wherein the image forming apparatus includes a drive unit configured to drive the laser light source, on an auxiliary pixel-by-auxiliary pixel basis, a generating unit configured to generate a clock on a pixel-by-pixel basis, and a memory unit configured to output the image data to said conversion unit in synchronism with the clock generated by said generating unit.

* * * * *